US007708485B2

(12) United States Patent
Tanaka et al.

(10) Patent No.: US 7,708,485 B2
(45) **Date of Patent: *May 4, 2010**

(54) CLEANING IMPLEMENT

(75) Inventors: Yoshinori Tanaka, Kagawa (JP); Tomokazu Suda, Kagawa (JP); Masatoshi Fujiwara, Kagawa (JP); Gregory Clegg Spooner, Hong Kong (HK); Hoss Vong, Hong Kong (HK)

(73) Assignee: Uni-Charm Corporation, Ehime-ken (JP)

( * ) Notice: Subject to any disclaimer, the term of this patent is extended or adjusted under 35 U.S.C. 154(b) by 1009 days.

This patent is subject to a terminal disclaimer.

(21) Appl. No.: 11/386,829

(22) Filed: Mar. 23, 2006

(65) Prior Publication Data

US 2006/0269353 A1 Nov. 30, 2006

(30) Foreign Application Priority Data

Apr. 5, 2005 (JP) ..... 2005-108307
Jan. 16, 2006 (JP) ..... 2006-007997

(51) Int. Cl.

| | |
|---|---|
| ***A47L 1/08*** | (2006.01) |
| ***A47L 13/26*** | (2006.01) |
| ***A47L 13/30*** | (2006.01) |
| ***A46B 11/00*** | (2006.01) |
| ***B43K 5/18*** | (2006.01) |
| ***B43M 11/06*** | (2006.01) |
| ***A47L 13/22*** | (2006.01) |
| ***A46B 11/06*** | (2006.01) |

(52) U.S. Cl. ..... 401/138; 401/136; 401/137; 401/139; 401/140; 401/263; 401/268

(58) Field of Classification Search ..... 401/136–140, 401/268, 263, 287, 289

See application file for complete search history.

(56) References Cited

U.S. PATENT DOCUMENTS 4,863,299 A 9/1989 Osberghaus et al.

(Continued)

FOREIGN PATENT DOCUMENTS

JP 50-018358 * 6/1975

(Continued)

OTHER PUBLICATIONS

International Search Report of PCT/JP2006/305048 issued Jun. 13, 2006.

(Continued)

*Primary Examiner*—David J. Walczak
*Assistant Examiner*—Ryan A Varnum
(74) *Attorney, Agent, or Firm*—Lowe Hauptman Ham & Berner

(57) ABSTRACT

A cleaning implement includes a cleaning head having a cleaning operation surface on a bottom, a holding portion arranged on the side opposite the cleaning head, a pipe for coupling the cleaning head and the holding portion, and a valve opening and closing device provided to the pipe so as to be able to hold a first container for receiving a first fluid or a second container for receiving a second fluid. The holding portion includes a lever coupled to the valve opening and closing device so as to open and close a first valve of the first container or a second valve of the second container. A first ejection nozzle can eject the first fluid forward of the cleaning head, and a second ejection nozzle can eject the second fluid rearward of the cleaning head.

16 Claims, 33 Drawing Sheets

U.S. PATENT DOCUMENTS

| | | | | |
|---|---|---|---|---|
| 5,782,991 | A * | 7/1998 | van der Heyden et al. | 134/37 |
| 6,722,806 | B2 * | 4/2004 | Kunkler et al. | 401/138 |
| 6,960,042 | B1 * | 11/2005 | Hsiao | 401/138 |
| 2004/0046628 | A1 * | 3/2004 | Hofte et al. | 336/115 |
| 2004/0141797 | A1 * | 7/2004 | Garabedian et al. | 401/279 |
| 2004/0184867 | A1 | 9/2004 | Wang et al. | |

FOREIGN PATENT DOCUMENTS

| | | | |
|---|---|---|---|
| JP | 50-018358 | Y1 | 6/1975 |
| JP | 64-5515 | A | 1/1989 |
| JP | 2004-337454 | | 12/2004 |
| JP | 2005-342255 | | 12/2005 |
| JP | 2005-342256 | | 12/2005 |
| JP | 2005-342258 | | 12/2005 |

OTHER PUBLICATIONS

Non-Final Action issued to U.S. Appl. No. 11/386,827, mailed Feb. 4, 2009.

* cited by examiner

CLEANING IMPLEMENT

This application is based on and claims the benefits of priories from Japanese Patent Application No. 2005-108307, filed on Apr. 5, 2005 and Japanese Patent Application No. 2006-007997, filed on Jan. 16, 2006, the contents of which are incorporated herein by reference.

BACKGROUND OF THE INVENTION

1. Field of the Invention

The present invention relates to cleaning implement. More particularly, the present invention relates to cleaning implements adapted to covers for floors or carpets, for example, and including a liquid supply device.

2. Related Art

By way of example, a cleaning implement including a liquid supply device is designed to have a cleaning head arranged at a distal end of a stem and a manual operation part arranged at a grip of the stem. A pressure-pump-type discharge container and a pump pusher are arrange at the distal end of the stem, and a coupling member for coupling the manual operating part to the pump pusher is arranged along the stem. By manual operation applied to the manual operation part, the pressure-pump-type discharge container is pressed through the coupling member and the pump pusher, discharging a solution from the discharge container to the cleaning head. Refer, for example, to Patent Document 1 (Japanese Published Unexamined Patent Application 2004-337454).

According to Patent Document 1, the cleaning implement allowing wet wiping is provided, which can operate quietly, discharge a solution stably, and contribute to weight reduction.

SUMMARY OF THE INVENTION

According to Patent Document 1, a solution can be sprayed forward of the cleaning head and in the vicinity thereof from a pump spray nozzle. However, when a polish or a wax is applied and wiped away on the floor, if cleaning operation is carried out in advance, an operator will step on the applied floor, raising a problem of leaving footprints, etc. on the applied floor, for example.

The cleaning implement constructed to spray a solution forward of the cleaning head and in the vicinity thereof sometimes raises a problem that a solution may be sprayed on interior furniture or electrical appliance. A cleaning implement may be considered that can spray a solution forward or rearward of the cleaning head by the operator's choice. This is a problem to be solved by the present invention.

In order to solve the above problem, an object of the present invention is to provide a cleaning implement including a cleaning head and a valve opening and closing device connected to the cleaning head and able to hold a first container receiving a first fluid or a second container receiving a second container, in which the cleaning implement can spray a solution forward or rearward of the cleaning head by operator's choice.

In order to achieve the above object, inventors have invented the following new cleaning implement configured such that a valve opening and closing device includes a connection mechanism from which a first container is detachable and an adaptor coupled to the connection mechanism and from which a second container is detachable, wherein a first circulation path extends to a first ejection nozzle for ejecting a first fluid from the connection mechanism to the outside of the cleaning head, and a second circulation path extends to a second ejection nozzle for ejecting a second fluid from the adapter.

In a first aspect of the present invention, a cleaning implement includes: a cleaning head; and a holding portion, a fluid being able to be ejected rearward of the cleaning head when using the cleaning implement by positioning the cleaning head at the front and the holding portion at the rear.

By way of example, the cleaning head may have a cleaning operation surface on a bottom, and the holding portion is arranged on the side opposite the cleaning head. The cleaning head and the holding portion are coupled by a pipe, for example. According to the first aspect of the present invention, when using the cleaning implement by positioning the cleaning head at the front and the holding portion at the rear, a fluid can be ejected rearward of the cleaning head. The fluid may be, for example, a second fluid as will be described later. By way of example, the cleaning implement according to the first aspect of the present invention can eject the second fluid such as polish or wax to the floor, and a user can apply the second fluid on the floor toward the rear. Thus, the user will not step on the applied floor. Moreover, since the second fluid is ejected to a space between the user and the cleaning head, the probability of spraying a solution on interior furniture or electrical appliance is reduced.

In a second aspect of the present invention, a cleaning implement includes: a cleaning head having a cleaning operation surface on a bottom; a holding portion arranged on the side opposite the cleaning head; a pipe that couples the cleaning head and the holding portion; and a valve opening and closing device provided to the pipe, the valve opening and closing device being able to hold one of a first container receiving a first fluid and a second container receiving a second container, the valve opening and closing device including a connection mechanism from which the first container is detachable and an adaptor coupled to the connection mechanism and from which the second container is detachable, the cleaning head including a first ejection nozzle which ejects the first fluid from the connection mechanism to the outside of the cleaning head, the adapter including a second ejection nozzle which ejects the second fluid from the adapter, the holding portion including a lever coupled to the valve opening and closing device, the lever opening and closing the first valve of the first container or the second valve of the second container, in which the first ejection nozzle can eject the first fluid forward of the cleaning head, and the second ejection nozzle can eject the second fluid rearward of the cleaning head when using the cleaning implement by positioning the cleaning head at the front and the holding portion at the rear.

The second aspect of the present invention includes a cleaning head having a cleaning operation surface on a bottom. Also, it includes a holding portion arranged on the side opposite the cleaning head. A pipe couples the cleaning head and the holding portion. A valve opening and closing device is provided to the pipe. The valve opening and closing device can hold a first container for receiving a first fluid or a second container for receiving a second fluid.

By way of example, the cleaning head may have a cleaning sheet detachably attached to the cleaning operation surface. The pipe may be a holding stem, and may be configured by connecting a plurality of pipes, for example. The valve opening and closing device may not be mounted at the position between the cleaning head and the holding portion, but at the position close to the cleaning head or at the position close to the holding portion. The valve opening and closing device is mounted, preferably, at the position close to the cleaning head. With the first and second containers, either of the two may be mounted to the valve opening and closing device without being both mounted thereto. The valves designate valves of the first and second containers. By actuation of the valve opening and closing device, the first or second fluid is ejected.

According to the second aspect of the present invention, the valve opening and closing device includes a connection mechanism from which the first container is detachable. It also includes an adapter coupled to the connection mechanism and from which the second container is detachable. The cleaning head includes a first ejection nozzle that ejects the first fluid from the connection mechanism to the outside of the cleaning head. The adapter includes a second ejection nozzle that ejects the second fluid from the adapter.

By way of example, provided to the connection mechanism are a cam device and pump as will be described later and for feeding the first fluid from the first container to the first ejection nozzle. The valve opening and closing device has a structure that allows the second container in place of the first container to be detached therefrom through the adapter. A path extending from the connection mechanism to the first ejection nozzle forms the first circulation path through which the first fluid can be ejected from the cleaning head. Furthermore, a path extending from the adapter to the second ejection nozzle forms the second circulation path through which the second fluid can be ejected from the adapter by interrupting the first circulation path.

According to the second aspect of the present invention, the holding portion includes a lever. The lever is coupled to the valve opening and closing device. The lever opens and closes the first valve of the first container or the second valve of the second container.

By way of example, as will be described layer, the holding portion includes a pulley rotated interlockingly with rotary motion of the lever. The connection mechanism includes the cam device including a rocker arm forming a dynamic articulation that reciprocates angularly and a pusher following the rocker arm to reciprocate linearly. When the lever is coupled to the valve opening and closing device, the belt may have one end caught at a moving end of the rocker arm and the other end wound on the pulley so as to transmit a displacement of the lever to the pusher. By interlocking the adaptor with displacement motion of the pusher, the second valve of the second container is opened and closed, for example.

According to the second aspect of the present invention, when using the cleaning implement by positioning the cleaning head at the front and the holding portion at the rear, the first ejection nozzle can eject the first fluid forward of the cleaning head, and the second ejection nozzle can eject the second fluid rearward of the cleaning head.

By way of example, the first fluid may be water, a liquid detergent or a liquid wax, and the second fluid may an atomized wax or a foamed wax. By operating the lever, the second fluid is ejected from the spout of the second ejection nozzle. The term "when using" may be, for example, a state while the cleaning head is placed on the floor, the holding portion is held by user's hands, and the pipe is operated at an angle of inclination of about 45 degrees. The first ejection nozzle can eject the first fluid forward of the cleaning head, or the second ejection nozzle can eject the second fluid rearward of the cleaning head. The second fluid may be ejected to a space between the cleaning head and the user. The second fluid is ejected in the direction substantially parallel to the pipe, for example. The second fluid is ejected, preferably, in the range of an open angle of plus or minus 20 degrees with respect to the direction substantially parallel to the pipe. The wording "ejected" includes a case in which the second fluid is diffused like a fine spray.

Thus, the cleaning implement according to the second aspect of the present invention is a cleaning implement including a cleaning head and a valve opening and closing device connected to the cleaning head and being able to hold a first container receiving a first fluid or a second container receiving a second container, in which the cleaning implement can spray a solution forward or rearward of the cleaning head by operator's choice.

The valve opening and closing device includes a connection mechanism from which a first container is detachable and an adaptor coupled to the connection mechanism and from which a second container is detachable, in which a first circulation path extends to a first ejection nozzle for ejecting a first fluid from the connection mechanism to the outside of the cleaning head, and a second circulation path extends to a second ejection nozzle for ejecting a second fluid from the adapter.

By way of example, the cleaning implement according to the second aspect of the present invention can eject the second fluid such as polish or wax from the second ejection nozzle to the floor, and the user can apply the second fluid on the floor toward the rear. Thus, the user will not step on the applied floor. Moreover, since the second fluid is ejected from the second ejection nozzle to a space between the user and the cleaning head, the probability of spraying a solution on interior furniture or electrical appliance is reduced.

In a third aspect of the present invention, a cleaning implement according to the second aspect of the present invention has a second ejection nozzle that includes a spout to eject the second fluid in the direction substantially parallel to the pipe.

A spout of the second ejection nozzle is arranged, for example, at a position away from the pipe by a predetermined distance so as to eject the second fluid toward the floor. The wording "eject the second fluid in the direction substantially parallel to the pipe" includes ejection in the range of a predetermined open angle with respect to the direction substantially parallel to the pipe. The predetermined open angle is, preferably, in the range of plus or minus 20 degrees. The second fluid is ejected from the second ejection nozzle toward the floor in accordance with operation of the lever.

In a fourth aspect of the present invention, a cleaning implement according to the second or third aspect of the present invention has a connection mechanism connected to the first valve of the first container.

According to the fourth aspect of the present invention, since the first valve of the first container is operated directly, the mechanism of the cleaning implement can be simplified, resulting in cost reduction of the cleaning implement.

In a fifth aspect of the present invention, a cleaning implement according to any one of the second to fourth aspect of the present invention has a first container that is of a type of a bottle, the bottle being moved in the direction parallel to an axis of the first valve so as to drop the first fluid naturally.

According to the fifth aspect of the present invention, the first container can be of a type of a bottle which is commercially available. The first container ensuring natural dropping of the first fluid suitable for cleaning can be mounted to the cleaning implement.

In a sixth aspect of the present invention, a cleaning implement according to any one of the second to fifth aspects of the present invention has a second ejection nozzle connected to the second valve of the second container.

According to the sixth aspect of the present invention, since the second ejection nozzle is directly connected to the second valve, the mechanism of the cleaning implement can be simplified, resulting in cost reduction of the cleaning implement.

In a seventh aspect of the present invention, a cleaning implement according to any one of the second to sixth aspects of the present invention has a second container that is a tilt-type spray can, the tilt-type spray can being tilted in the direction orthogonal to an axis of the second valve so as to eject the second fluid.

According to the seventh aspect of the present invention, since a tilt-type spray can for receiving a polish or a wax suitable for application on the floor can be mounted to the cleaning implement, for example, the second fluid suitable for application on the floor can be used easily.

In an eighth aspect of the present invention, a cleaning implement according to any one of the second to seventh aspects of the present invention has a connection mechanism that includes a cam device including a rocker arm forming a dynamic articulation that reciprocates angularly and a pusher following the rocker arm to reciprocate linearly, the holding portion including a pulley rotated interlockingly with rotary motion of the lever and a belt having one end caught at a moving end of the rocker arm and the other end wound on the pulley, the belt transmitting a displacement of the lever to the pusher.

According to the eighth aspect of the present invention, the belt may be used as a means for transmitting motion of the lever of the holding portion to the rocker arm of the connection mechanism, providing excellent flexibility. Thus, even if an articulation part exists between the holding portion and the connection mechanism, motion of the lever of the holding portion can surely be transmitted to the rocker arm.

In a ninth aspect of the present invention, a cleaning implement according to the eighth aspect of the present invention has an adaptor that includes a cylindrical adaptor main body, a cylinder held inside the adaptor main body to be movable axially and the second ejection nozzle coupled to the cylinder, the adaptor main body having one end having a first connection port detachably held to the connection mechanism and the other end having a second connection port for detachably holding the second container, the cylinder having one end abutting on a distal end of the pusher toward the first connection port and the other end having an inclined portion that intersects the axial direction of the cylinder at an acute angle toward the second connection port, in which the second ejection nozzle is formed in a T-shape, the T-shaped second ejection nozzle having one end coupled to the inclined portion and the other end connected to the second valve, the T-shaped second ejection nozzle having a spout at a T-shaped end for ejecting the second fluid to the outside of the adaptor main body.

According to the ninth aspect of the present invention, the adapter includes a cylindrical adapter main body. It also includes a cylinder movably held inside the adaptor main body to be movable axially. It further includes the second ejection nozzle coupled to the cylinder. The adaptor main body has one end having a first connection port detachably held to the connection mechanism and the other end having a second connection port for detachably holding the second container.

According to the ninth aspect of the present invention, the cylinder has one end abutting on a distal end of the pusher toward the first connection port and the other end having an inclined portion that intersects the axial direction of the cylinder at an acute angle toward the second connection port. The second ejection nozzle is formed in a T-shape. The T-shaped second ejection nozzle has one end coupled to the inclined portion and the other end connected to the second valve. The T-shaped second ejection nozzle has a spout at a T-shaped end for ejecting the second fluid to the outside of the adaptor main body.

A weight reduction can be achieved, for example, by molding out of a synthetic resin the adapter main body, cylinder, and second ejection nozzle that are components of the adapter. The adapter may be mounted to the valve opening and closing device in place of the first container. When operating the lever, movement of the pusher is transmitted to the cylinder. When the cylinder is moved, the inclined portion at the other end of the cylinder operates to tilt the second ejection nozzle. The second fluid is supplied from the second container to the second ejection nozzle. On the other hand, when releasing the lever, the pusher returns to the position, and the cylinder returns to the pusher side interlockingy with returning of a tilting posture of the second ejection nozzle. While the cylinder reciprocates, an angle of the inclined portion is, preferably, in the range of 30 to 60 degrees. Thus, the cleaning implement of the present invention can eject the second fluid as appropriate by operating the lever.

In a tenth aspect of the present invention, a cleaning implement according to the ninth aspect of the present invention has a cylinder that includes a pair of side walls arranged on both sides of the inclined portion with a space, the second valve having a part arranged in the space.

A distal end of the second valve is coupled by being restrained by the pair of side walls.

In an eleventh aspect of the present invention, a cleaning implement according to the eighth aspect of the present invention has an adaptor that includes a cylindrical adaptor main body, a cylinder held inside the adaptor main body to be movable axially and the second ejection nozzle coupled to the cylinder, the adaptor main body having one end having a first connection port detachably held to the connection mechanism and the other end having a second connection port for detachably holding the second container, in which the second ejection nozzle includes an L-shaped portion and a collar formed with the L-shaped portion and extending in the direction orthogonal to the axis of the second valve, the cylinder having one end abutting on a distal end of the pusher toward the first connection port and the other end having a protrusion that can push the collar in a position distant from the second valve, the L-shaped portion having a first end coupled to the second valve and a second end formed with a spout for ejecting the second fluid to the outside of the adaptor main body.

According to the eleventh aspect of the present invention, the adaptor includes a cylindrical adaptor main body. It also includes a cylinder held inside the adaptor main body to be movable axially. It further includes the second ejection nozzle coupled to the cylinder. The adaptor main body having one end having a first connection port detachably held to the connection mechanism and the other end having a second connection port for detachably holding the second container.

According to the eleventh aspect of the present invention, the second ejection nozzle includes an L-shaped portion and a collar formed with the L-shaped portion and extending in the direction orthogonal to the axis of the second valve. The cylinder has one end abutting on a distal end of the pusher toward the first connection port and the other end having a protrusion that can push the collar in a position distant from the second valve. The T-shaped portion has one end coupled to the second valve and the other end formed with a spout for ejecting the second fluid to the outside of the adaptor main body.

According to the eleventh aspect of the present invention having a structure different from that of the eighth aspect of the present invention, the second ejection nozzle is tilted based on this principle.

The cleaning implement according to the present invention is a cleaning implement including a cleaning head and a valve opening and closing device connected to the cleaning head and being able to hold a first container receiving a first fluid or a second container receiving a second container, in which the cleaning implement can spray a fluid forward or rearward of the cleaning head by operator's choice.

By way of example, the cleaning implement according to the present invention can eject the second fluid such as polish or wax from the second ejection nozzle to the floor, and the user can apply the second fluid on the floor toward the rear. Thus, the user will not step on the applied floor. Moreover, since the second fluid is ejected from the second ejection nozzle to a space between the user and the cleaning head, the possibility of spraying a solution on an interior furniture or electrical appliance becomes lower.

DETAILED DESCRIPTION OF THE INVENTION

Figure 1:
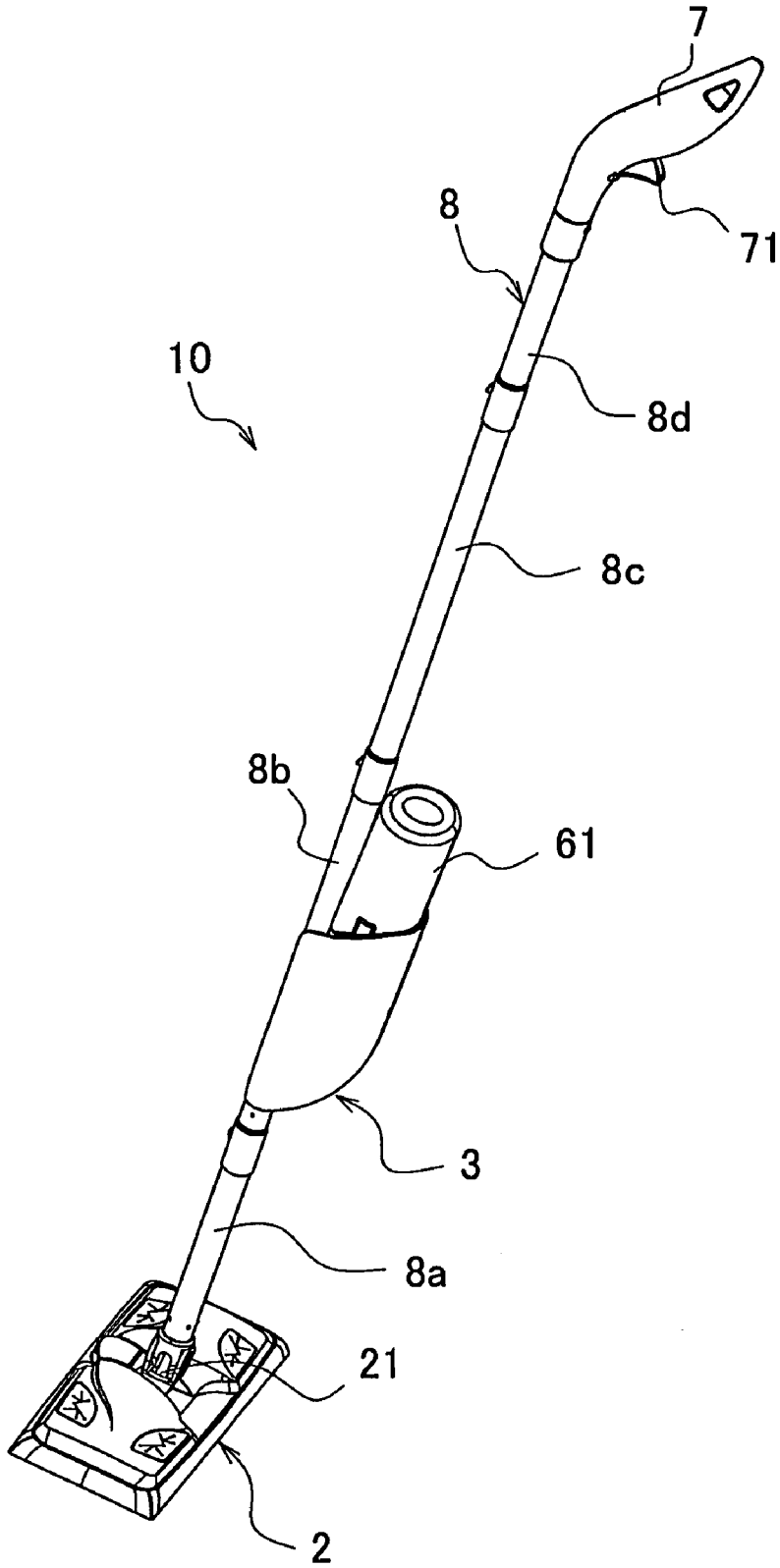
FIG. 1 is a perspective external view of a cleaning implement according to an embodiment of the present invention.

Referring to the drawings, a best mode for carrying out the invention will be described hereinbelow.

Figure 2:
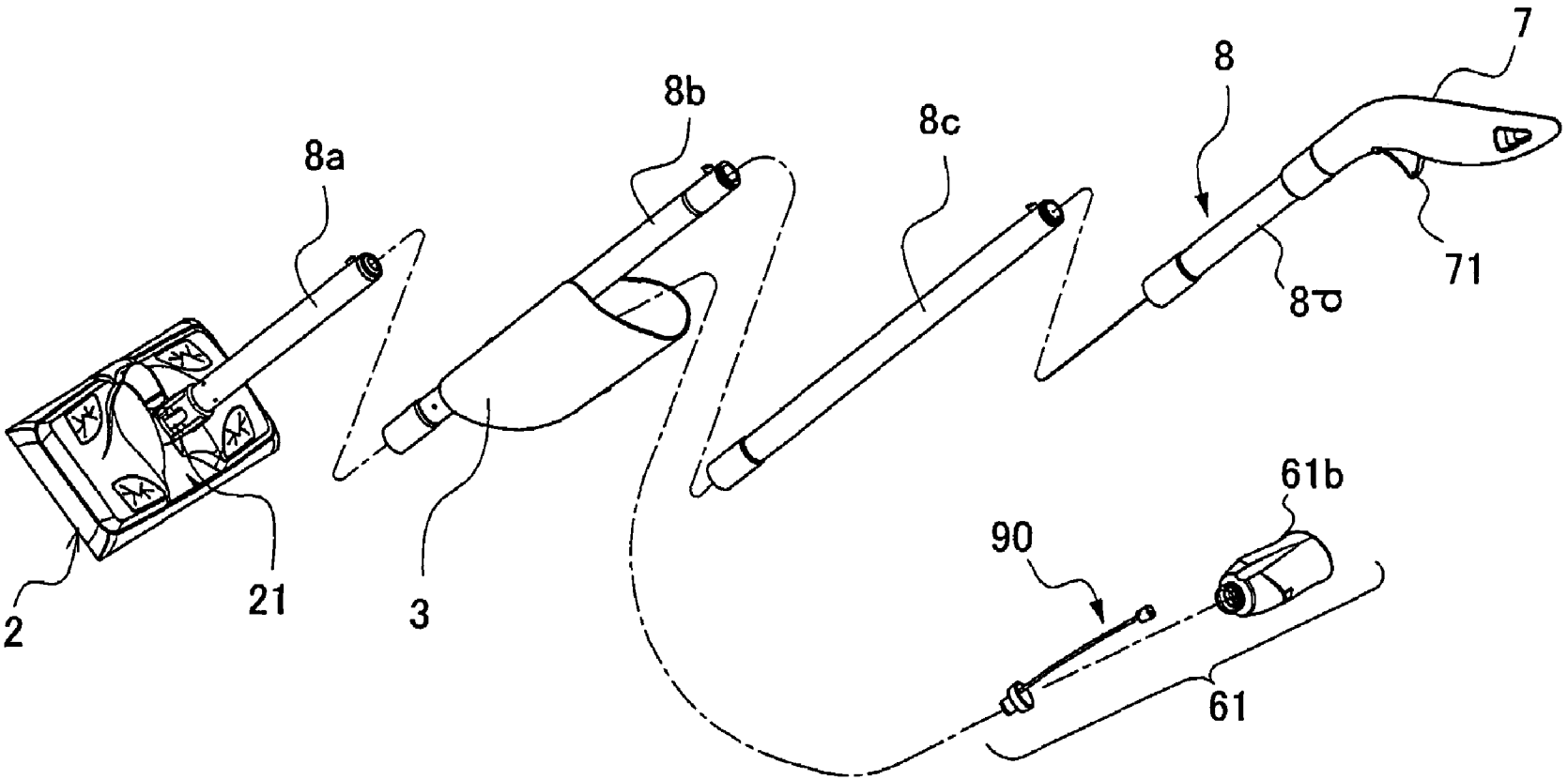
FIG. 2 is a perspective exploded view of the cleaning implement according to the embodiment.
Figure 3:
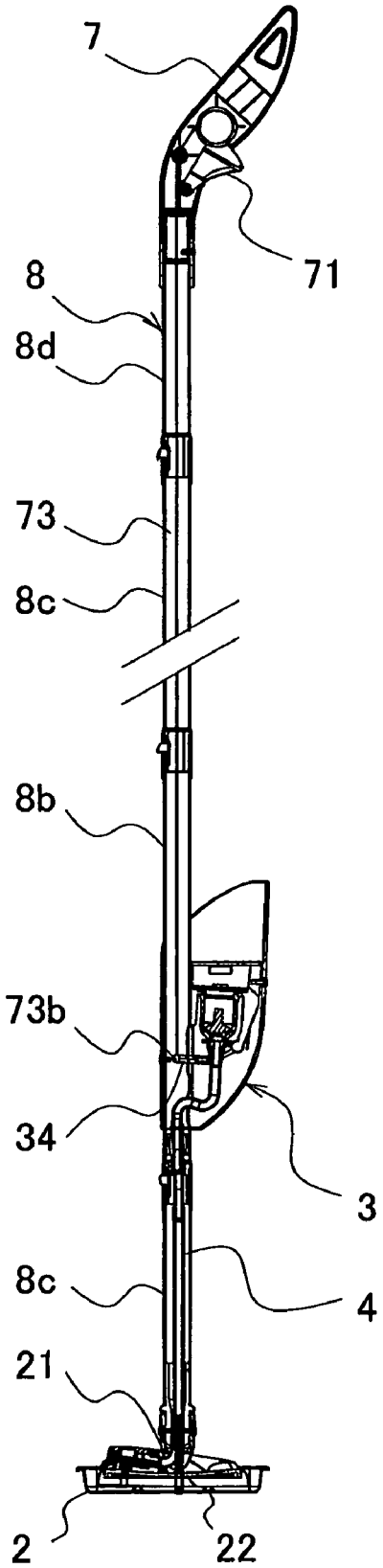
FIG. 3 is a longitudinal sectional view of the cleaning implement according to the embodiment.
Figure 4:
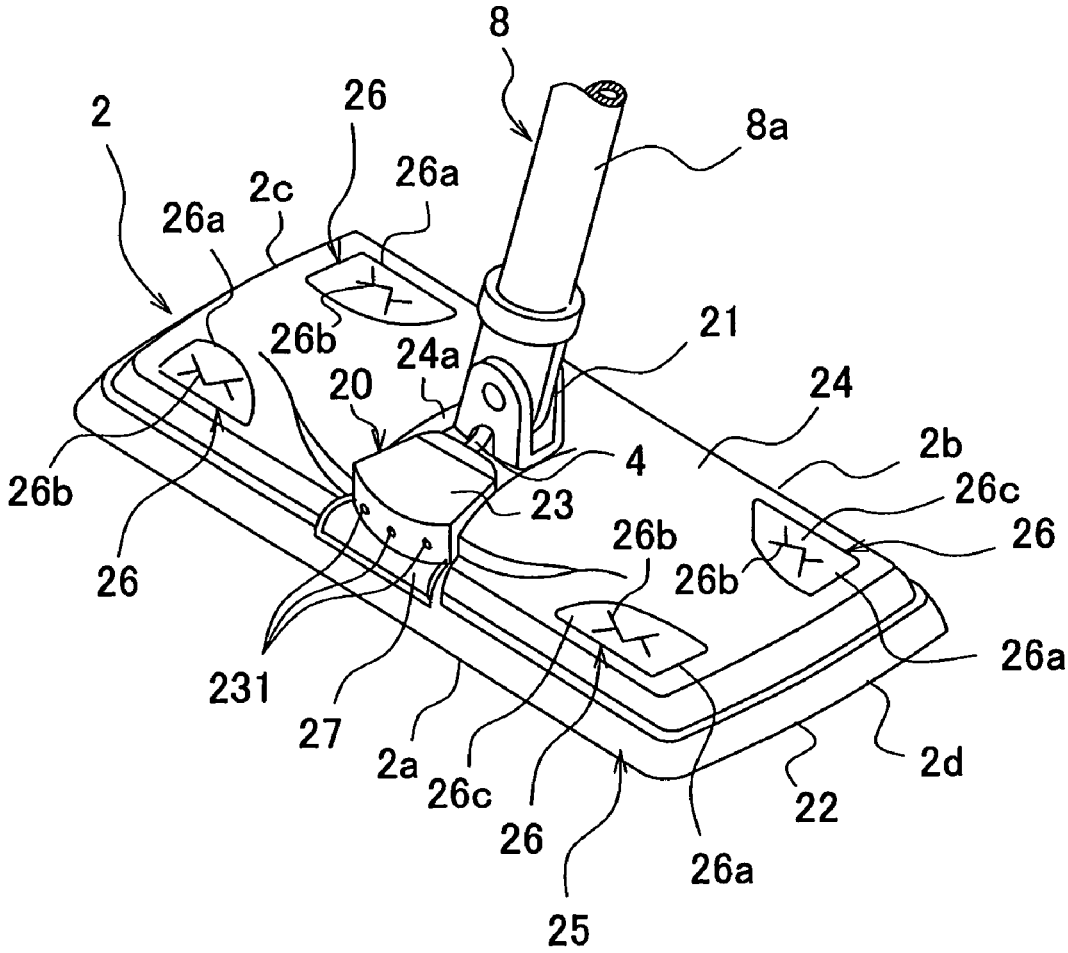
FIG. 4 is a perspective external view of a cleaning head of the cleaning implement according to the embodiment.
Figure 5:
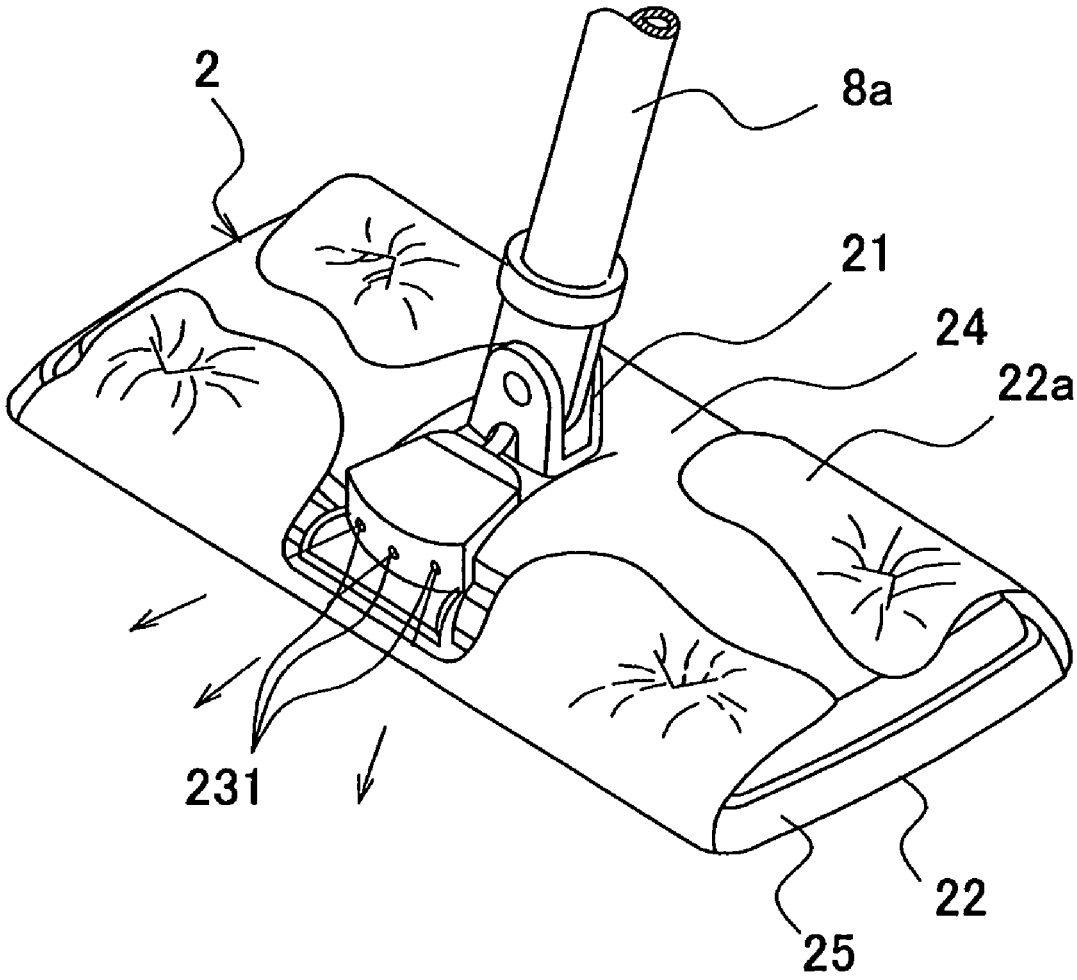
FIG. 5 is a fragmentary perspective external view of the cleaning head according to the embodiment.
Figure 6:
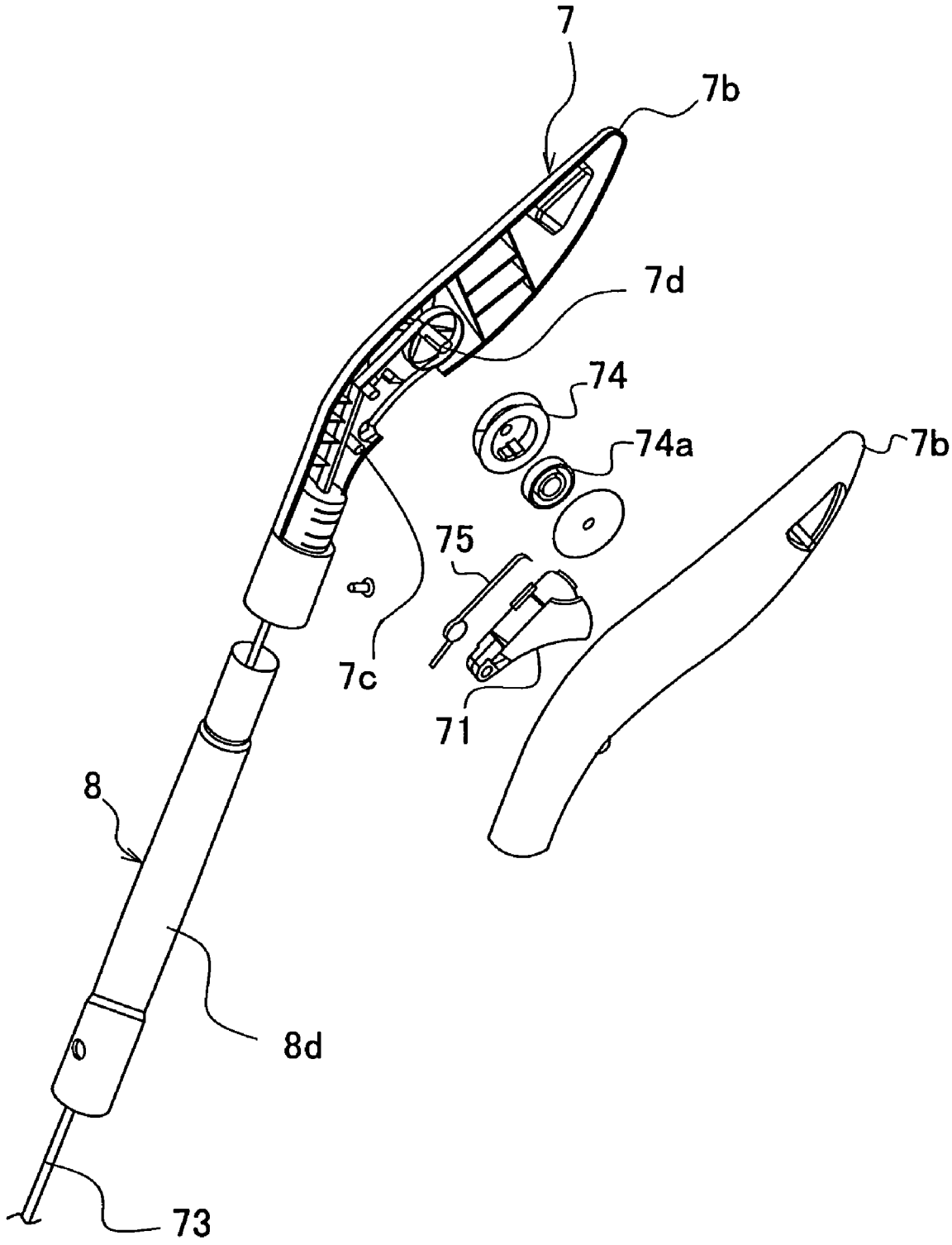
FIG. 6 is a perspective exploded view of a holding portion of the cleaning implement according to the embodiment.
Figure 7:
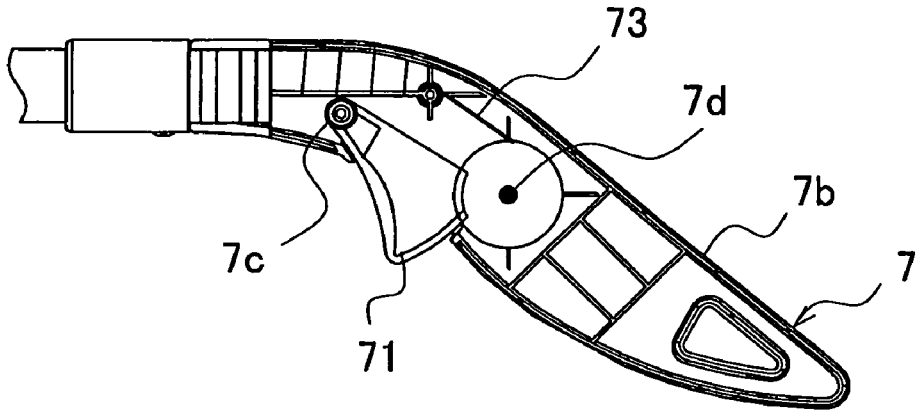
FIG. 7 is a fragmentary exploded sectional view of the holding portion according to the embodiment.
Figure 8:
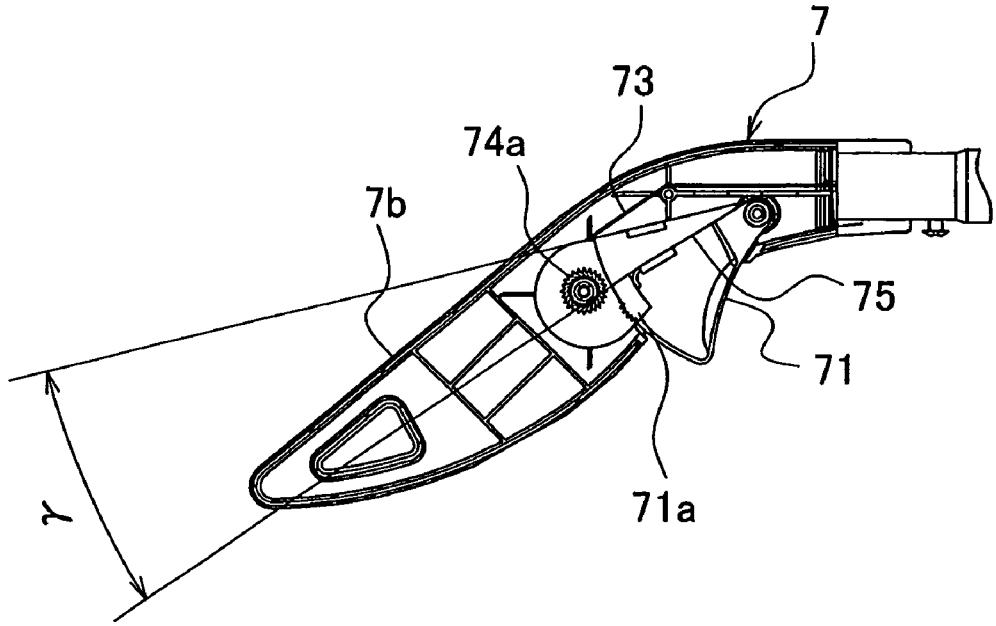
FIG. 8 is a fragmentary exploded sectional view of the holding portion according to the embodiment.
Figure 9:
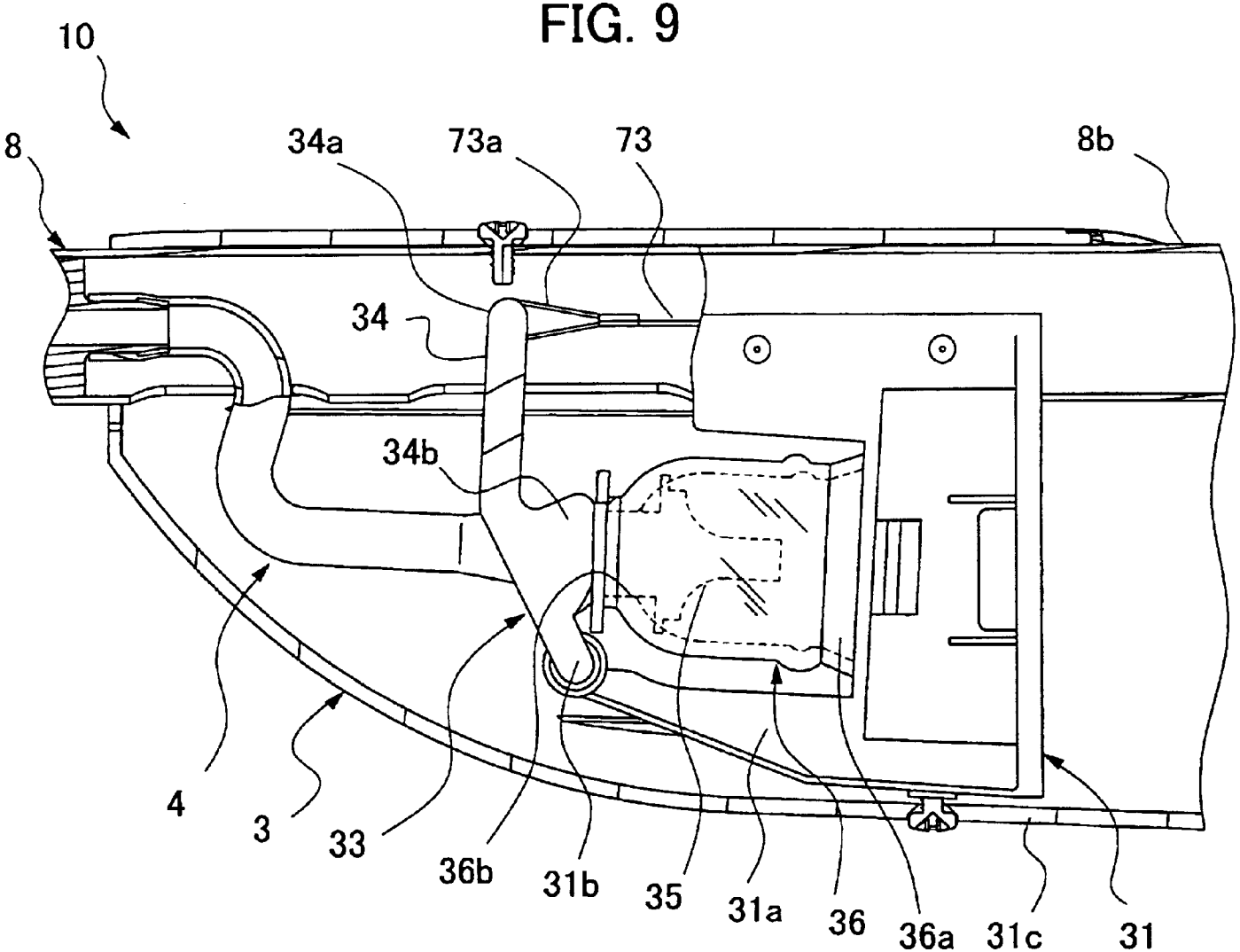
FIG. 9 is a fragmentary exploded sectional view of a valve opening and closing device of the cleaning implement according to the embodiment.
Figure 10:
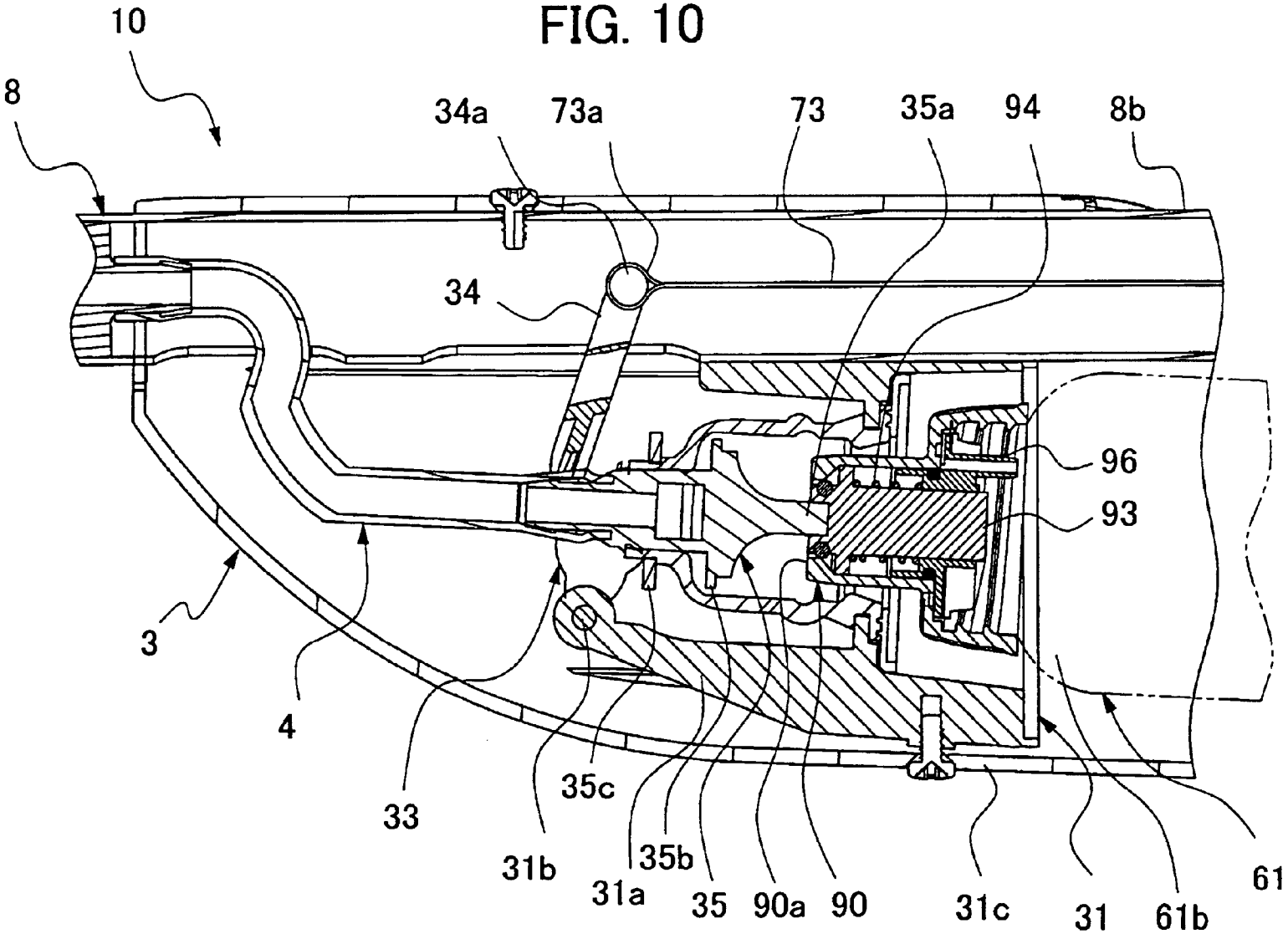
FIG. 10 is a fragmentary exploded sectional view of a valve opening and closing device according to the embodiment.
Figure 11:
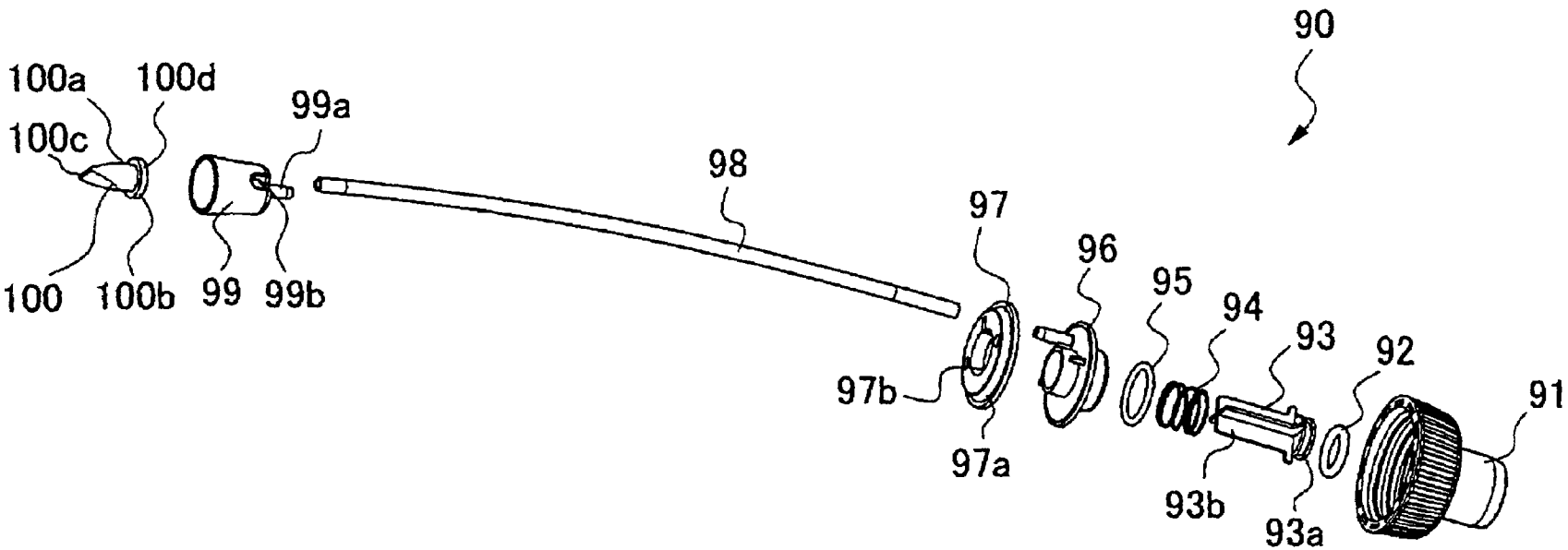
FIG. 11 is a structural view showing an internal structure of a cap of the cleaning implement according to the embodiment.
Figure 12A:
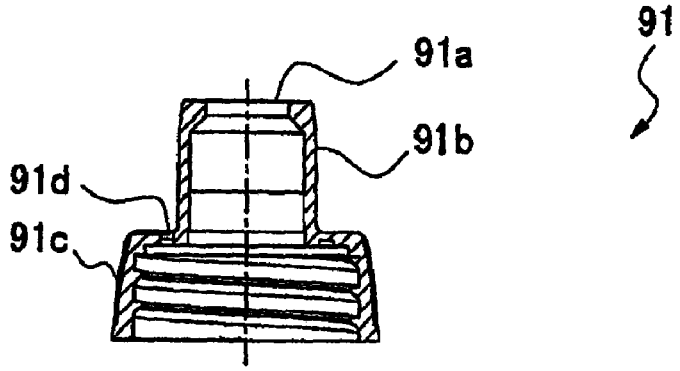
FIGS. 12A to 12C are schematic views showing a structure of a cap main body of the cleaning implement according to the embodiment.
Figure 12B:
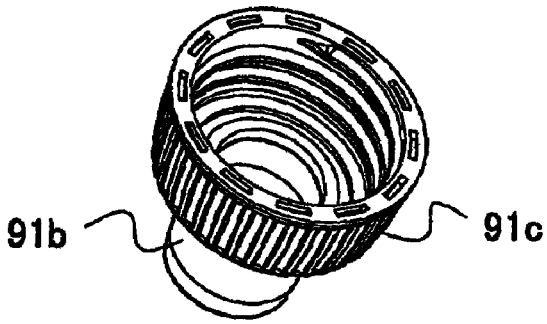
Figure 12C:
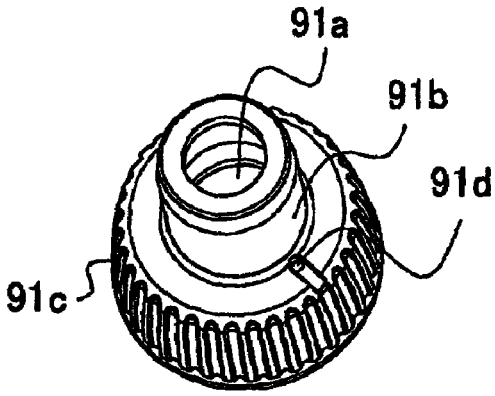
Figure 13A:
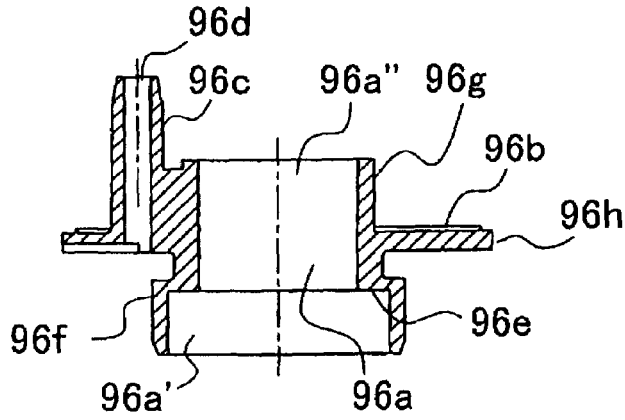
FIGS. 13A to 13C are schematic views showing a valve housing of the cleaning implement according to the embodiment.
Figure 13B:
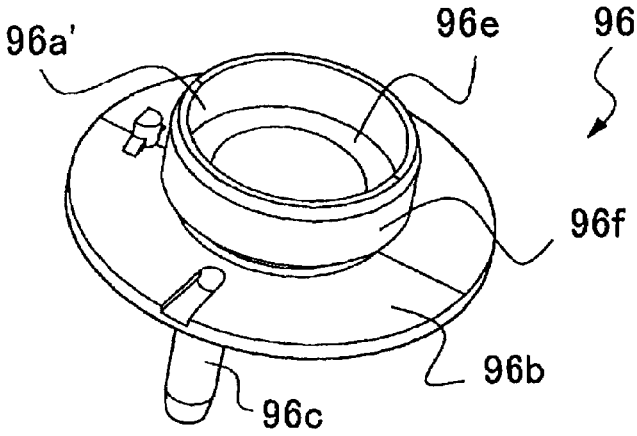
Figure 13C:
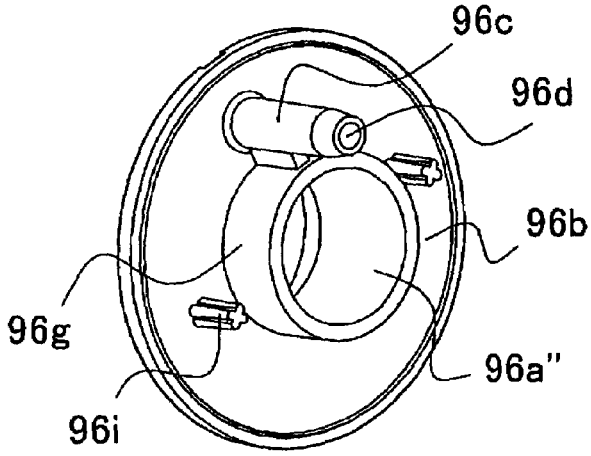

FIG. 1 is a perspective external view of a cleaning implement according to an embodiment of the present invention. FIG. 2 is a perspective exploded view of the cleaning implement according to the embodiment. FIG. 3 is a longitudinal sectional view of the cleaning implement according to the embodiment. FIG. 4 is a perspective external view of a cleaning head of the cleaning implement according to the embodiment. FIG. 5 is a fragmentary perspective external view of the cleaning head according to the embodiment. FIG. 6 is a perspective exploded view of a holding portion of the cleaning implement according to the embodiment. FIG. 7 is a fragmentary exploded sectional view of the holding portion according to the embodiment. FIG. 8 is a fragmentary exploded sectional view of the holding portion according to the embodiment. FIG. 9 is a fragmentary exploded sectional view of a valve opening and closing device of the cleaning implement according to the embodiment. FIG. 10 is a fragmentary exploded sectional view of a valve opening and closing device according to the embodiment. FIG. 11 is a structural view showing an internal structure of a cap of the cleaning implement according to the embodiment. FIGS. 12A to 12C are schematic views showing a structure of a cap main body of the cleaning implement according to the embodiment. FIGS. 13A to 13C are schematic views showing a valve housing of the cleaning implement according to the embodiment.

Figure 14:
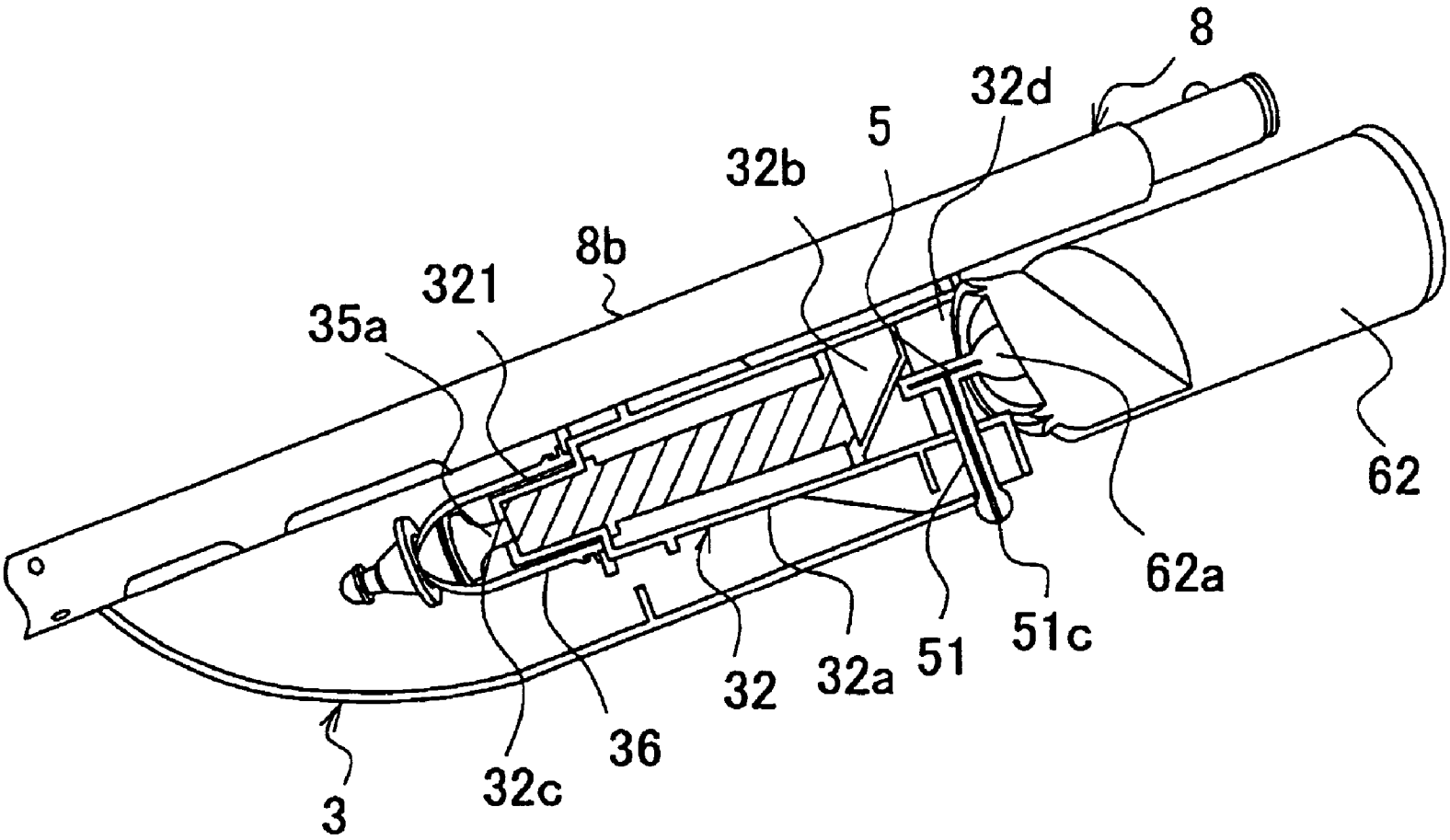
FIG. 14 is a perspective external view, partly broken, showing a main part of the valve opening and closing device according to the embodiment.
Figure 15:
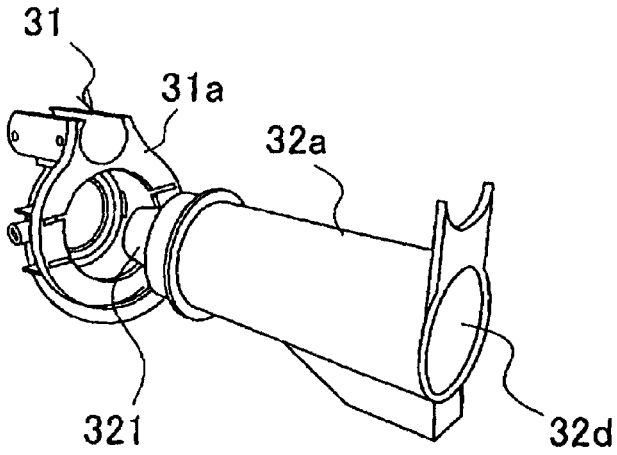
FIG. 15 is a perspective external view showing an adaptor and a connection mechanism according to the embodiment.
Figure 16:
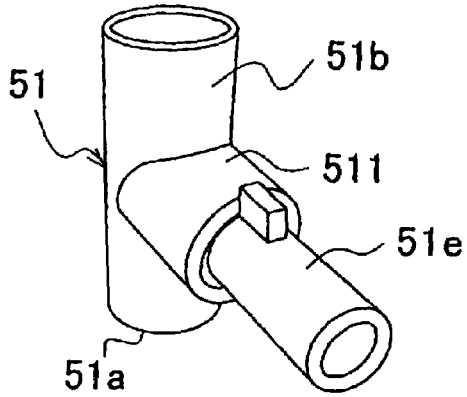
FIG. 16 is a perspective external view showing part of a second circulation path according to the embodiment.
Figure 17:
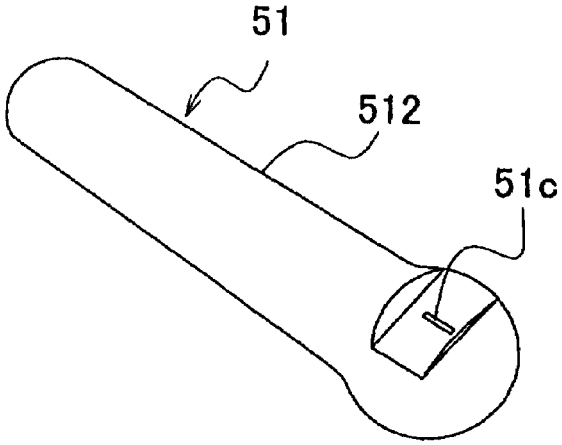
FIG. 17 is a perspective external view showing another part of a second circulation path according to the embodiment.
Figure 18:
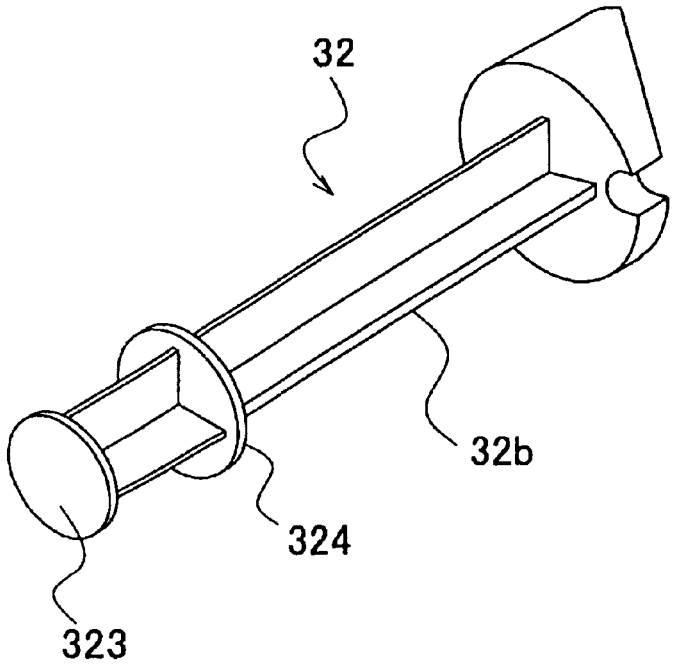
FIG. 18 is a perspective external view of a cylinder of the cleaning implement according to the embodiment.
Figure 19:
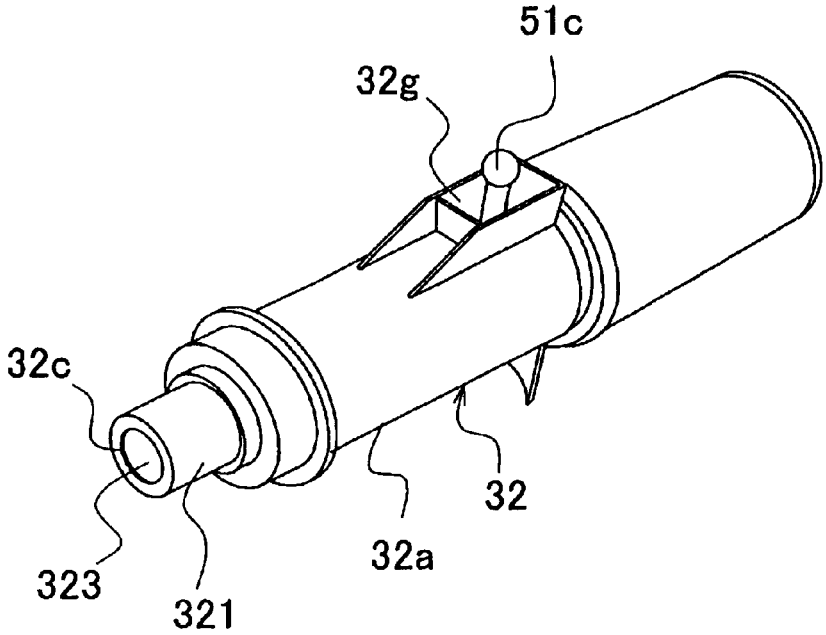
FIG. 19 is a perspective external view showing a state in which a second container is mounted to the adaptor according to the embodiment.
Figure 20:
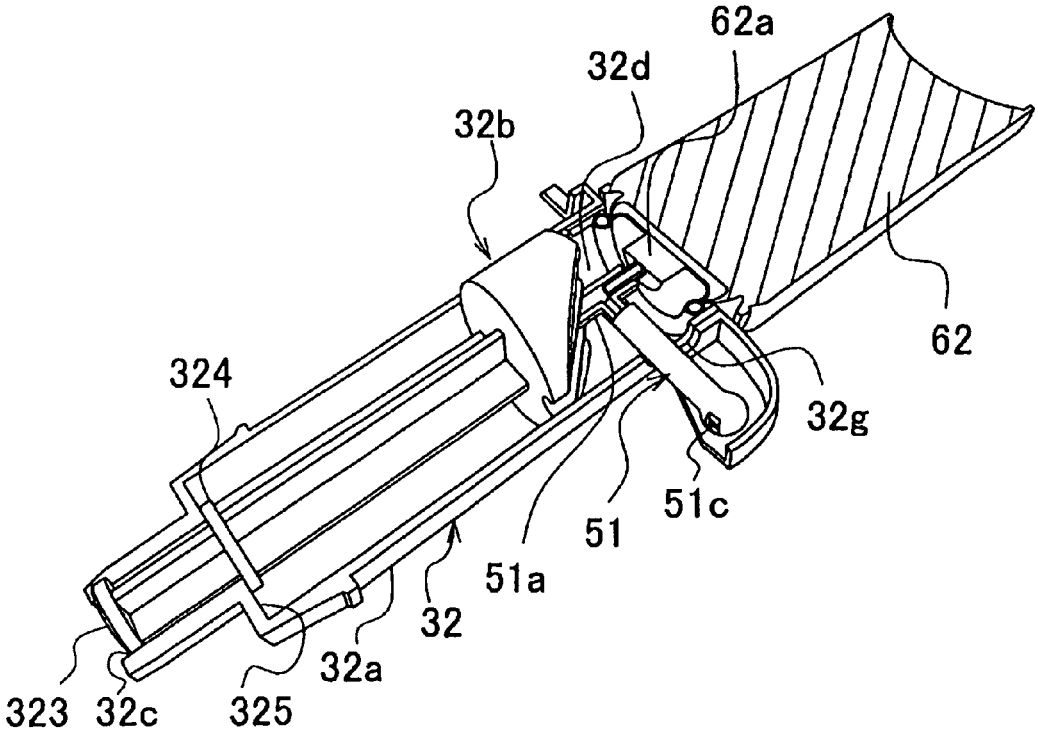
FIG. 20 is a longitudinal sectional view showing a state in which a second container is mounted to the adaptor according to the embodiment.
Figure 21:
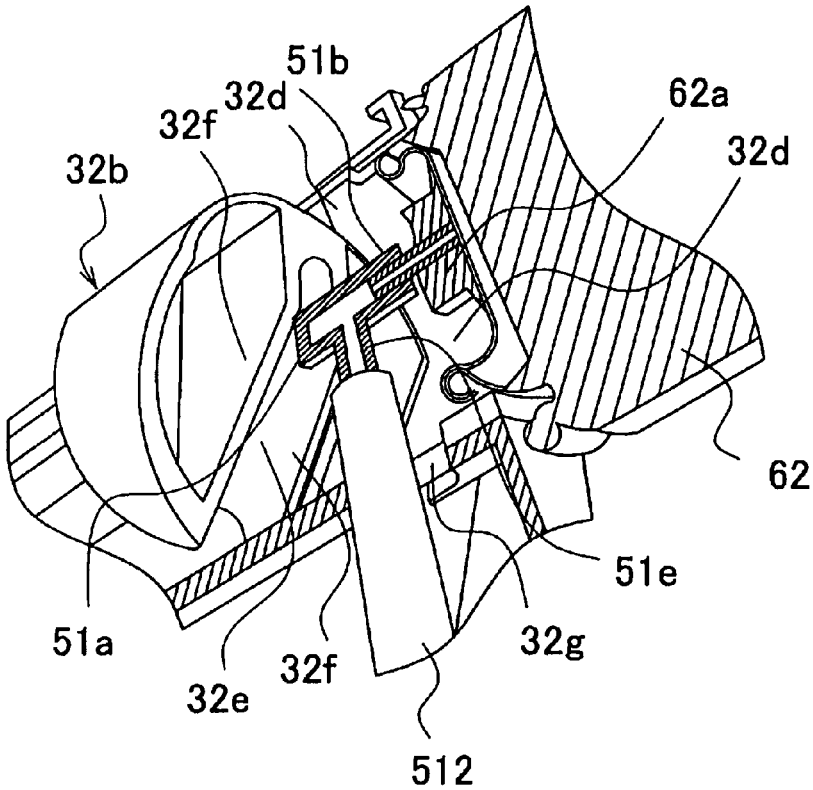
FIG. 21 is a fragmentary exploded sectional view showing a state in which a second container is mounted to the adaptor according to the embodiment.
Figure 22:
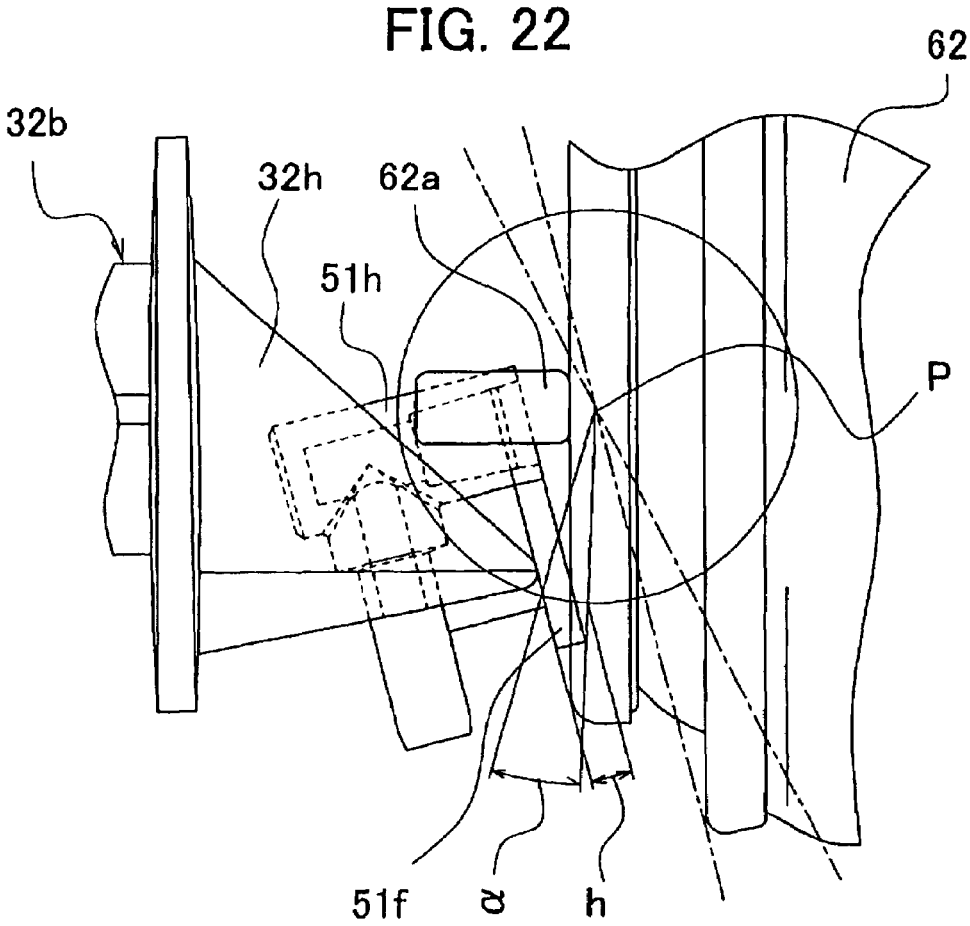
FIG. 22 is a fragmentary exploded view of the cleaning implement according to another embodiment.
Figure 23:
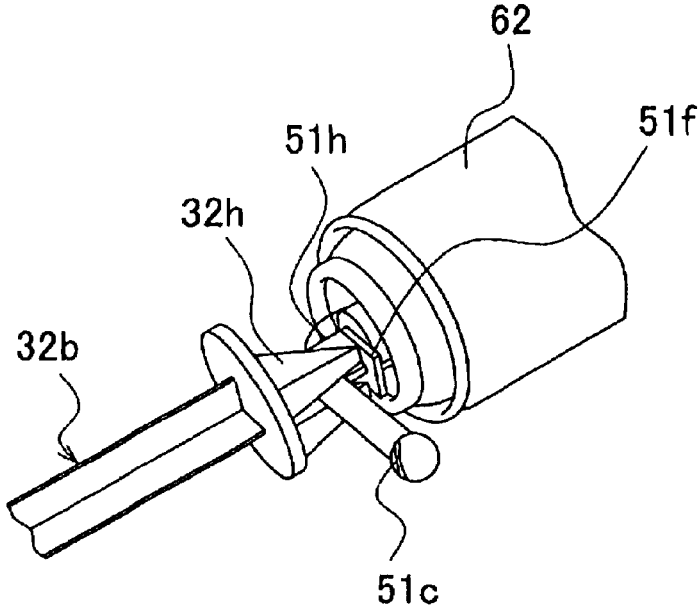
FIG. 23 is a fragmentary perspective exploded view of the embodiment.

FIG. 14 is a perspective external view, partly broken, showing a main part of the valve opening and closing device according to the embodiment. FIG. 15 is a perspective external view showing an adaptor and a connection mechanism according to the embodiment. FIG. 16 is a perspective external view showing part of a second circulation path according to the embodiment. FIG. 17 is a perspective external view showing another part of the second circulation path according to the embodiment. FIG. 18 is a perspective external view of a cylinder of the cleaning implement according to the embodiment. FIG. 19 is a perspective external view showing a state in which a second container is mounted to the adaptor according to the embodiment. FIG. 20 is a longitudinal sectional view showing a state in which the second container is mounted to the adaptor according to the embodiment. FIG. 21 is a fragmentary exploded sectional view showing a state in which the second container is mounted to the adaptor according to the embodiment. FIG. 22 is a fragmentary exploded view of a cleaning implement to another embodiment. FIG. 23 is a fragmentary perspective exploded view of the embodiment.

Figure 24:
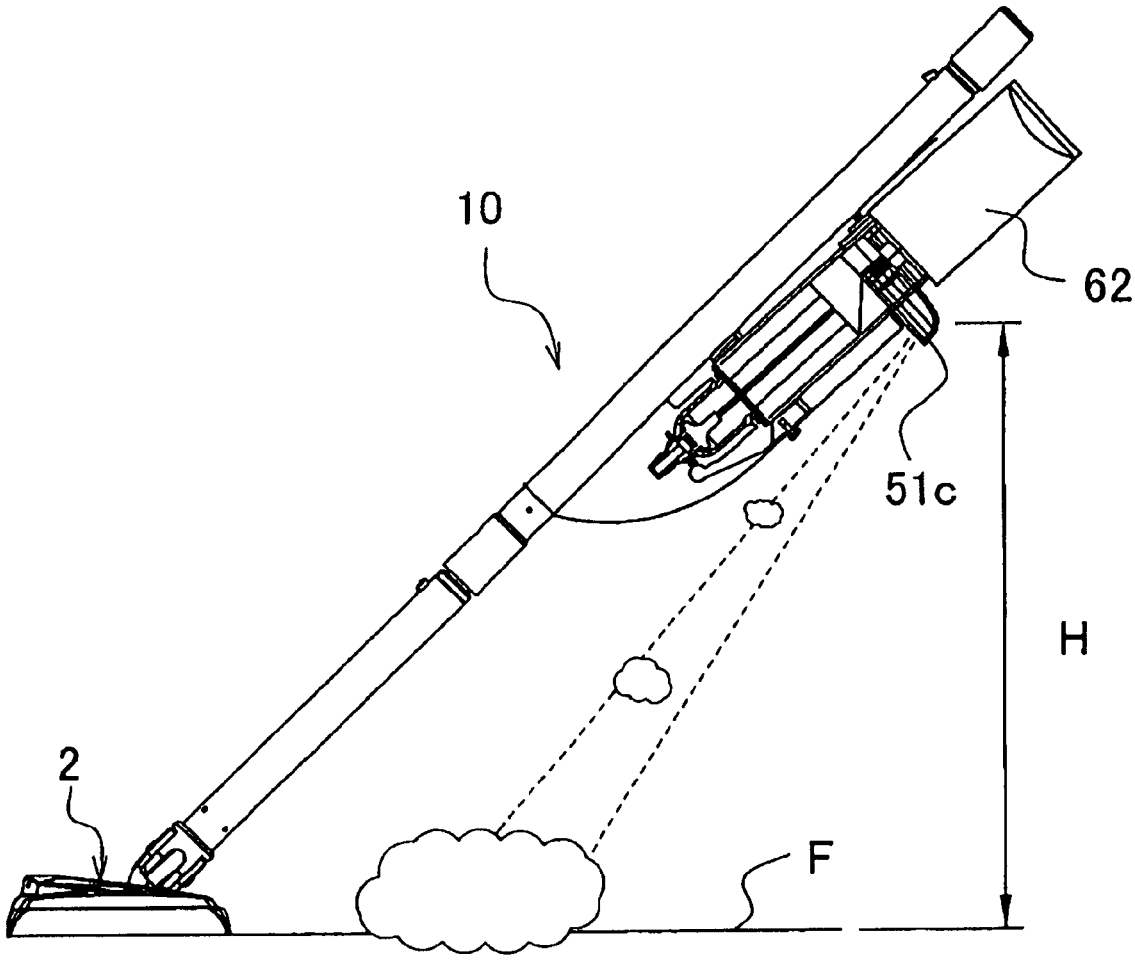
FIG. 24 is a perspective external view showing a service state of the cleaning implement according to the embodiment.
Figure 25:
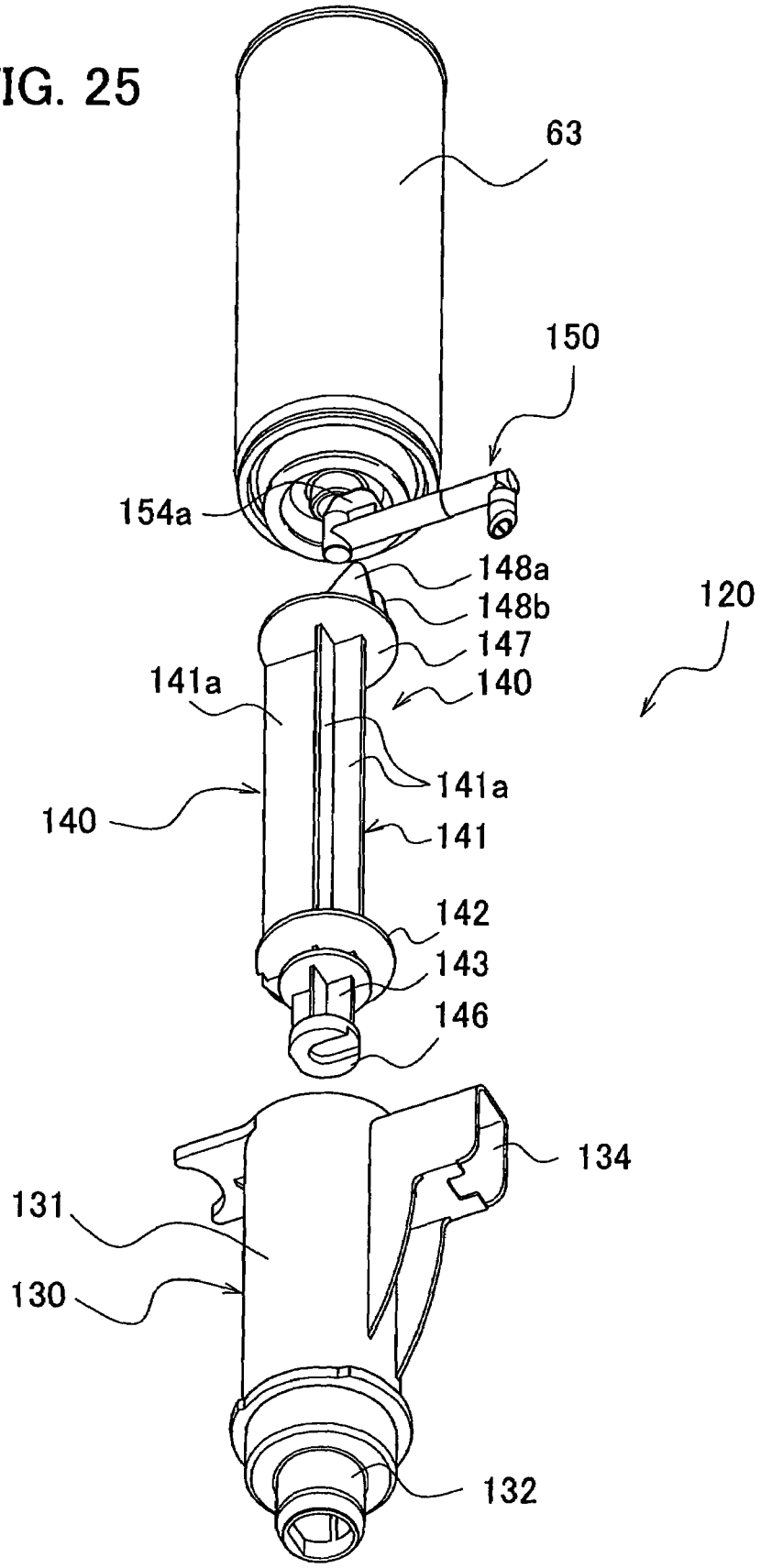
FIG. 25 is a perspective exploded view of a cleaning implement in still another embodiment.
Figure 26:
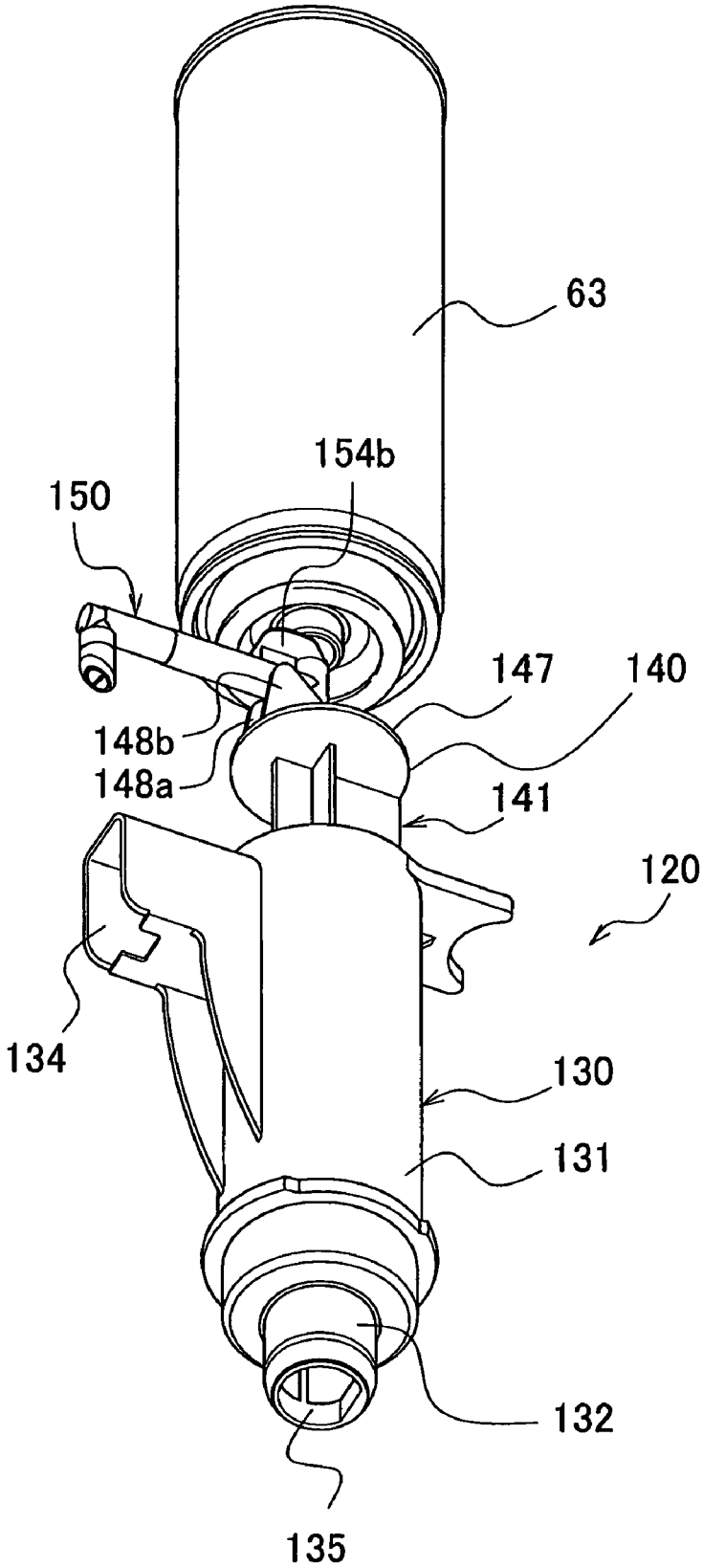
FIG. 26 is a perspective exploded view of the cleaning implement in the embodiment.
Figure 27:
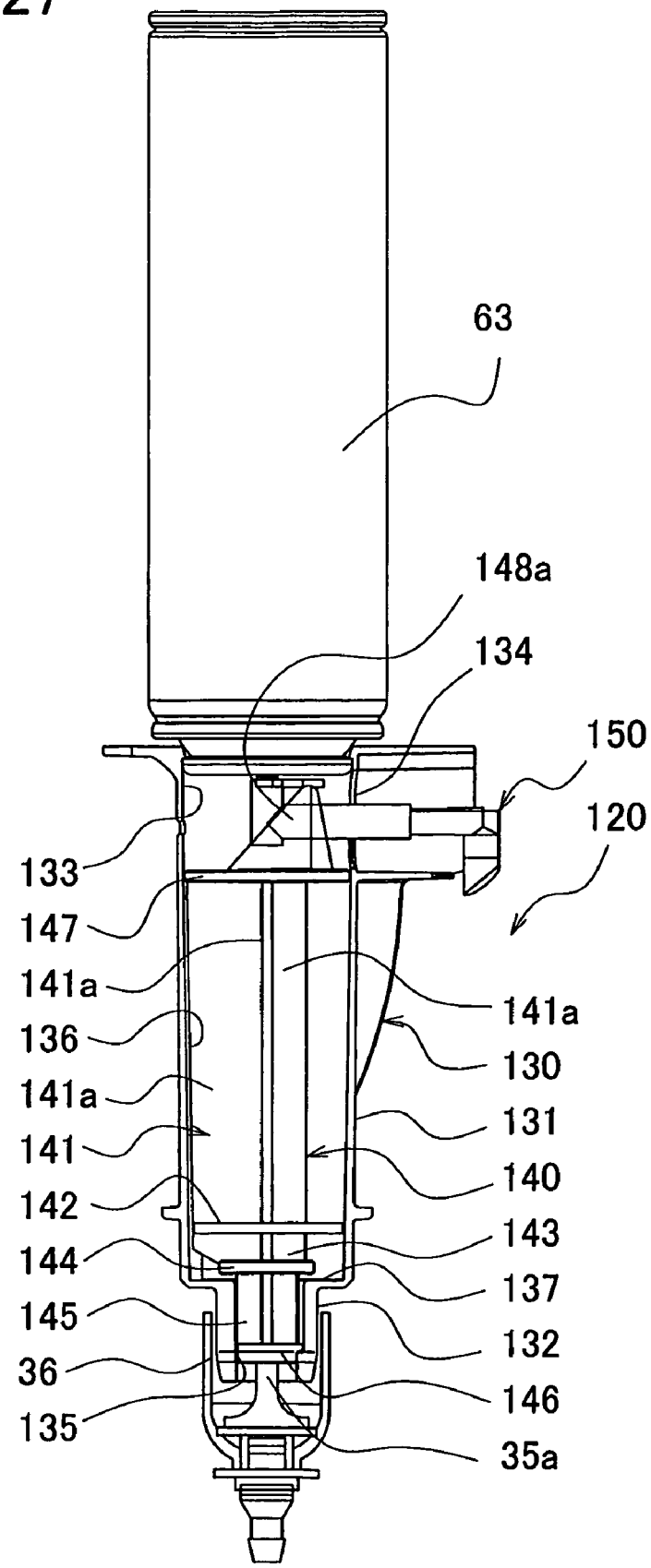
FIG. 27 is a longitudinal sectional view of the cleaning implement in the embodiment.
Figure 28:
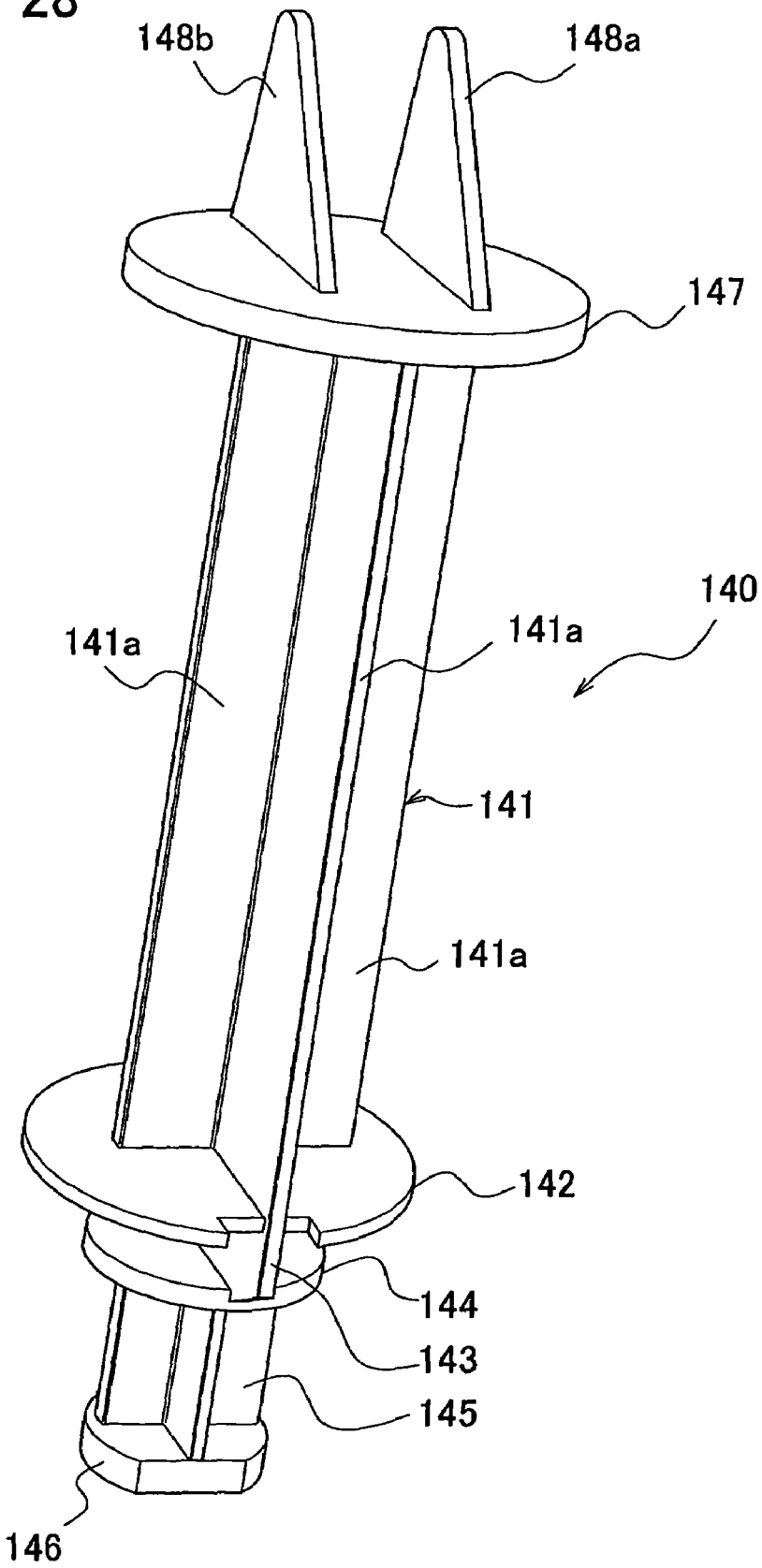
FIG. 28 is a perspective view of the cylinder of the cleaning implement in the embodiment.
Figure 29:
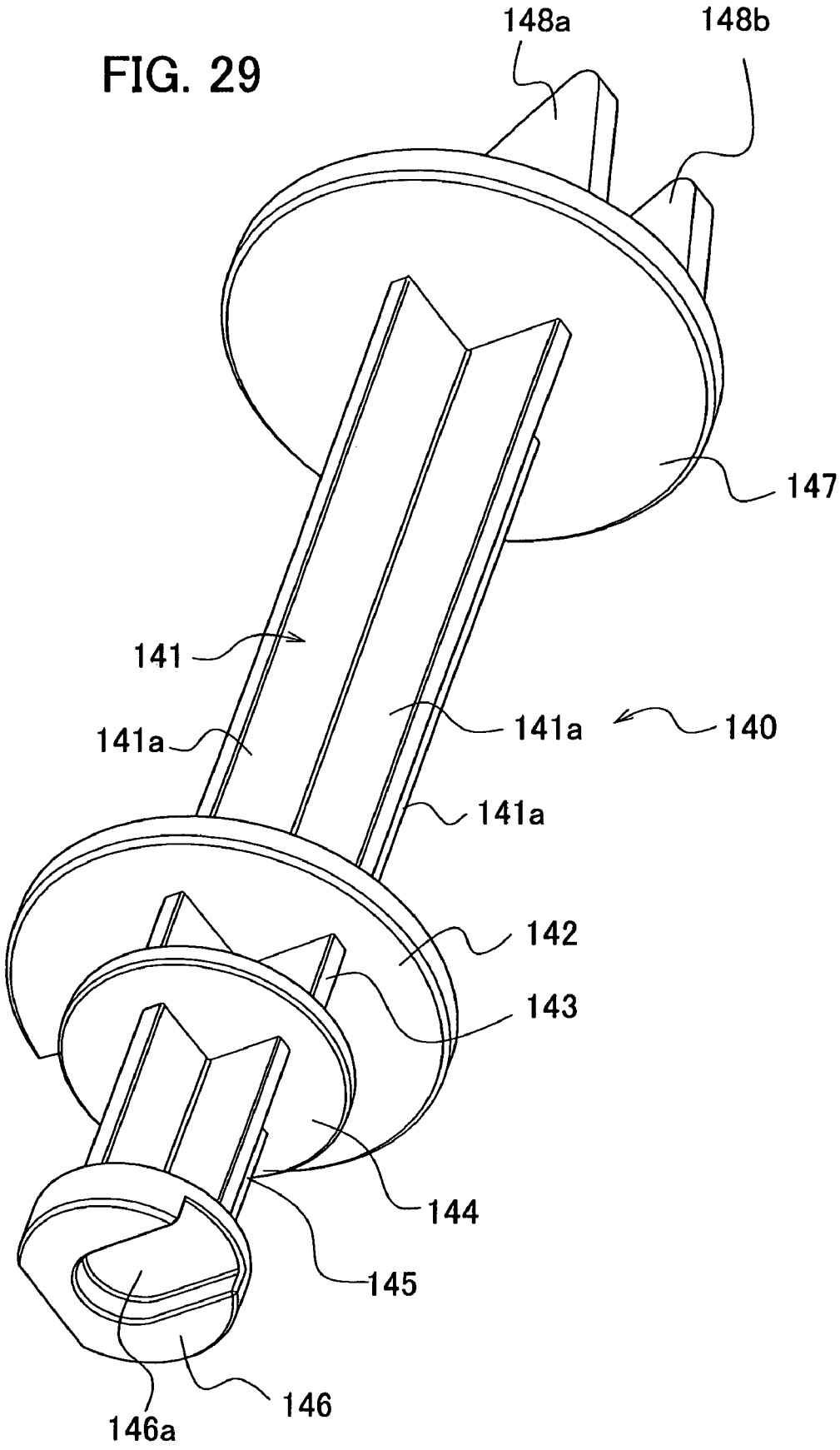
FIG. 29 is a perspective view of the cylinder of the cleaning implement in the embodiment.
Figure 30:
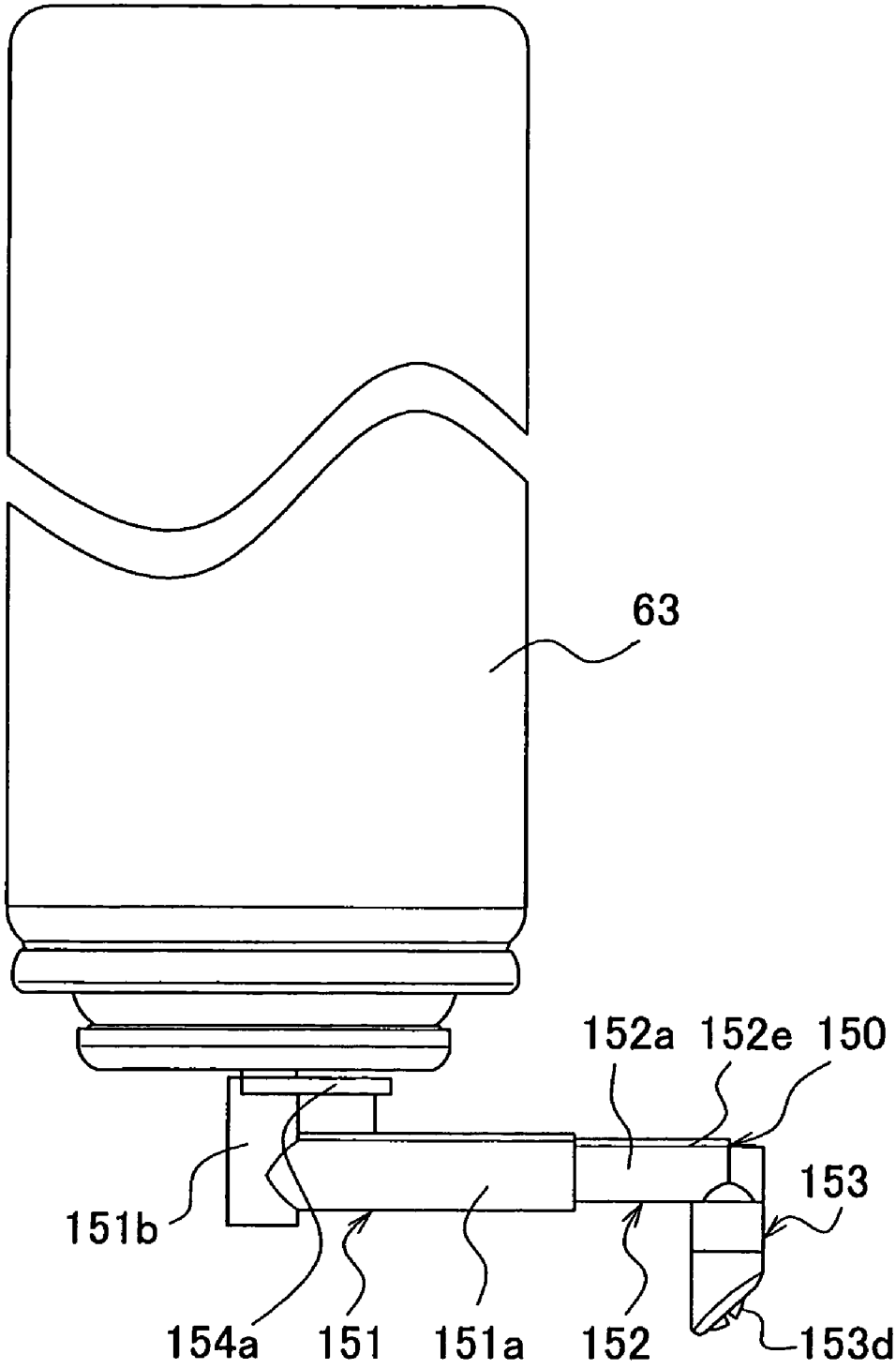
FIG. 30 is an external view of a third container and third ejection nozzle of the cleaning implement in the embodiment.
Figure 31:
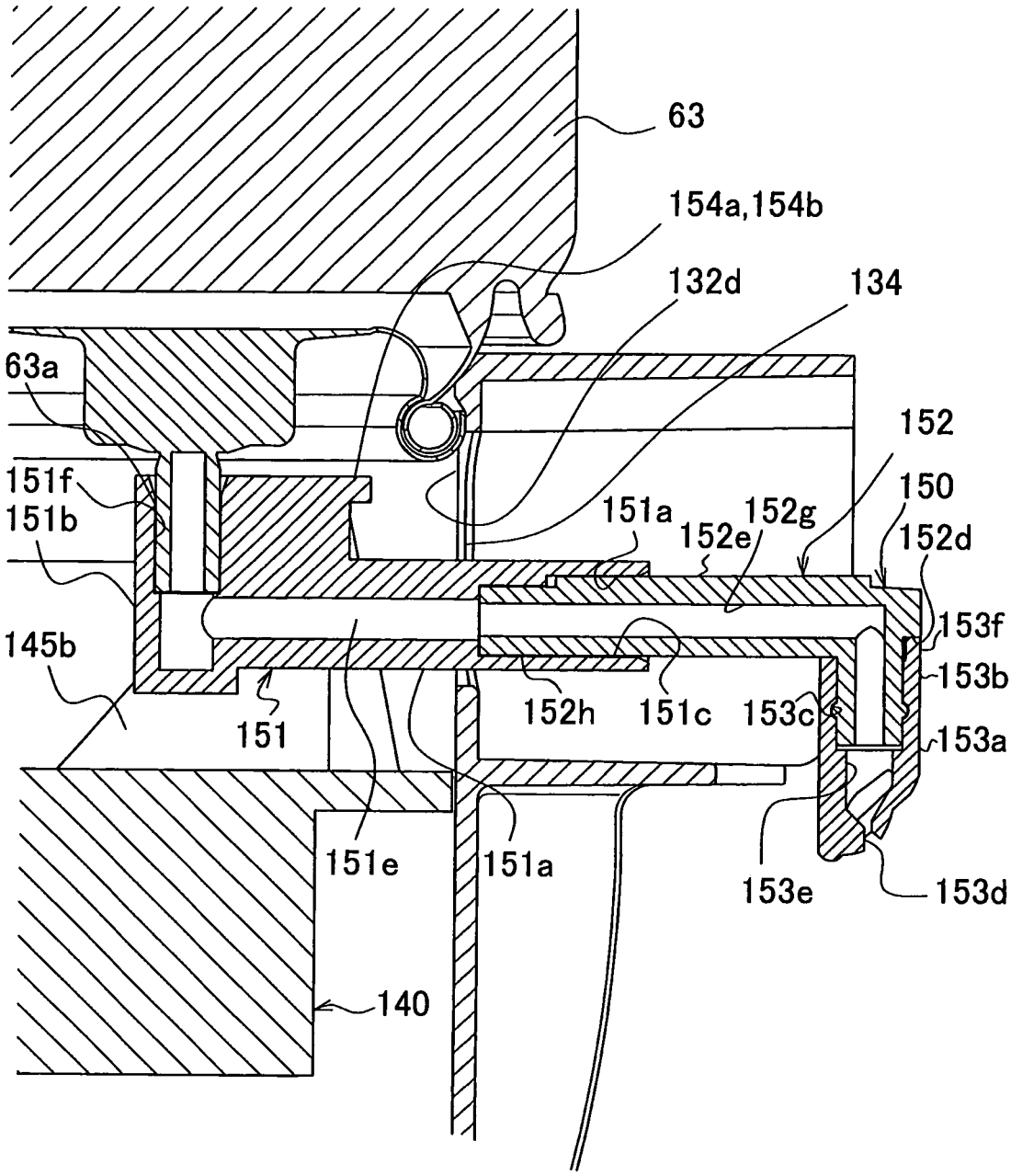
FIG. 31 is a longitudinal sectional view of third container and the third ejection nozzle of the cleaning implement in the embodiment.
Figure 32:
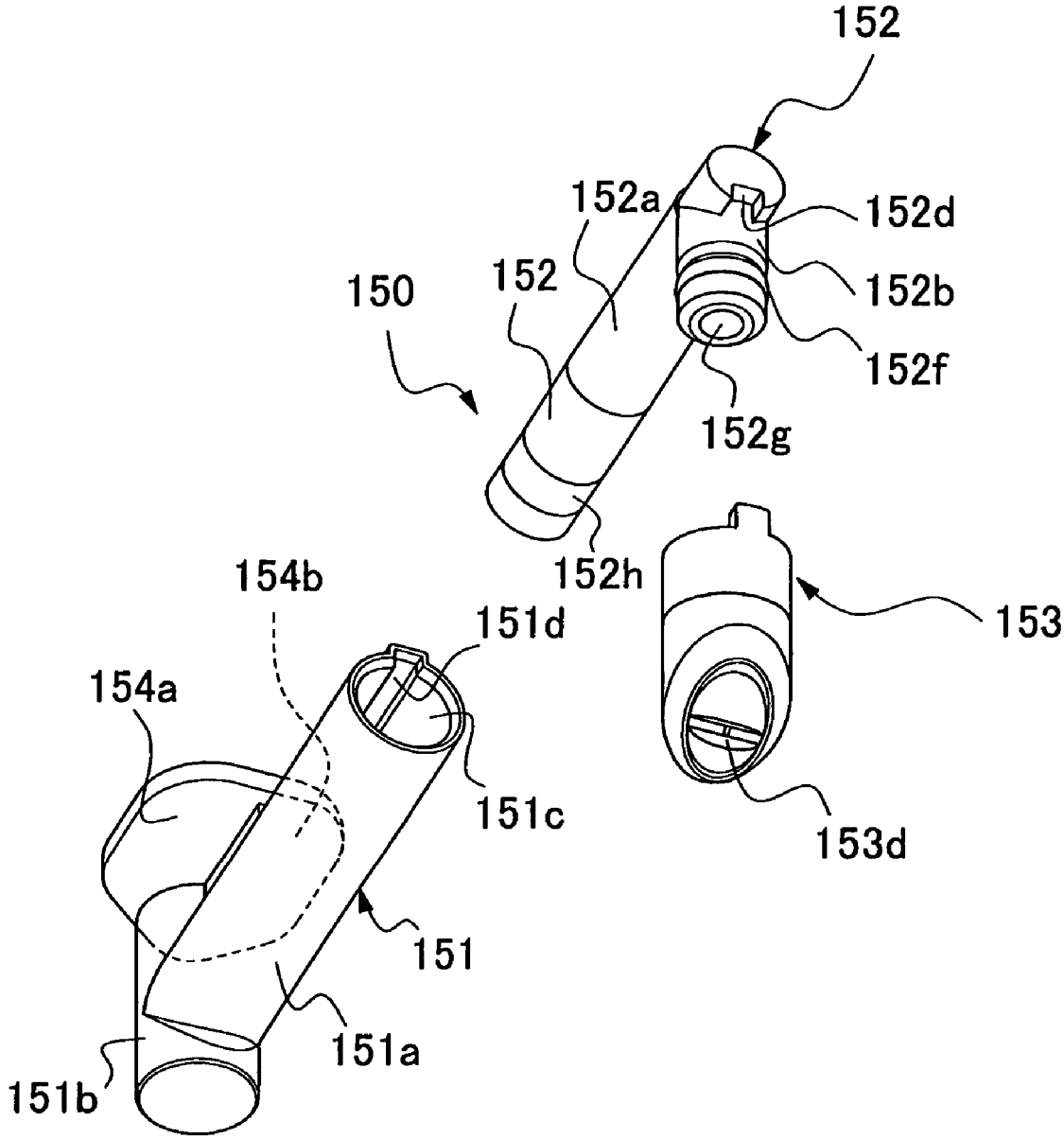
FIG. 32 is a perspective exploded view of the third ejection nozzle of the cleaning implement in the embodiment.
Figure 33:
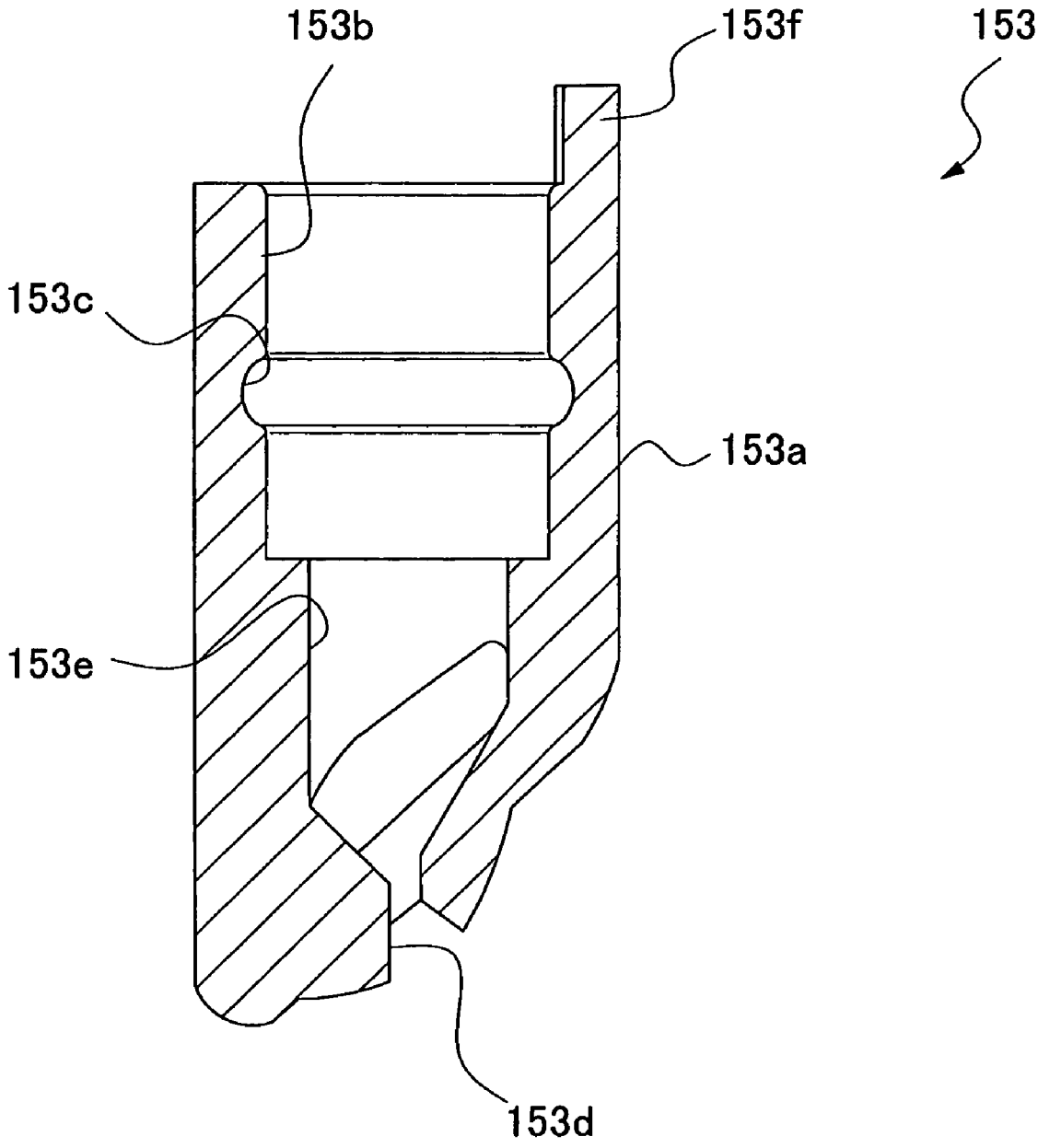
FIG. 33 is a longitudinal sectional view of the third ejection nozzle of the cleaning implement in the embodiment.

FIG. 24 is a perspective external view showing a using state of the cleaning implement according to another embodiment. FIG. 25 is a perspective exploded view of a cleaning implement in still another embodiment. FIG. 26 is a perspective exploded view of the cleaning implement in the embodiment. FIG. 27 is a longitudinal sectional view of the cleaning implement in the embodiment. FIG. 28 is a perspective view of a cylinder of the cleaning implement in the embodiment. FIG. 29 is a perspective view of the cylinder of the cleaning implement in the embodiment. FIG. 30 is an external view of a third container and a third ejection nozzle of the cleaning implement in the embodiment. FIG. 31 is a longitudinal sectional view of the third container and the third ejection nozzle of the cleaning implement in the embodiment. FIG. 32 is a perspective exploded view of the third ejection nozzle of the cleaning implement in the embodiment. FIG. 33 is a longitudinal sectional view of the third ejection nozzle of the cleaning implement in still another embodiment.

Figure 34:
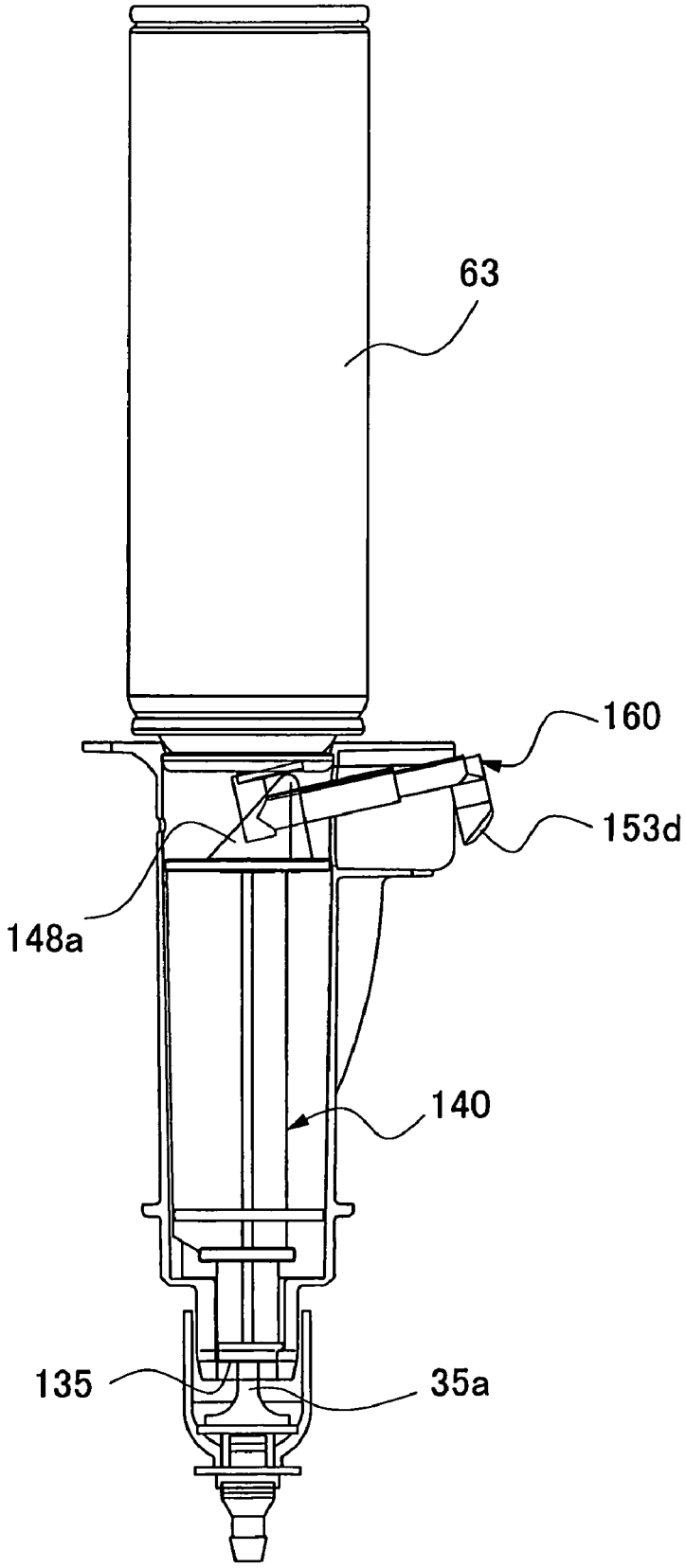
FIG. 34 is a longitudinal sectional view showing a service state of the cleaning implement in the another embodiment.
Figure 35:
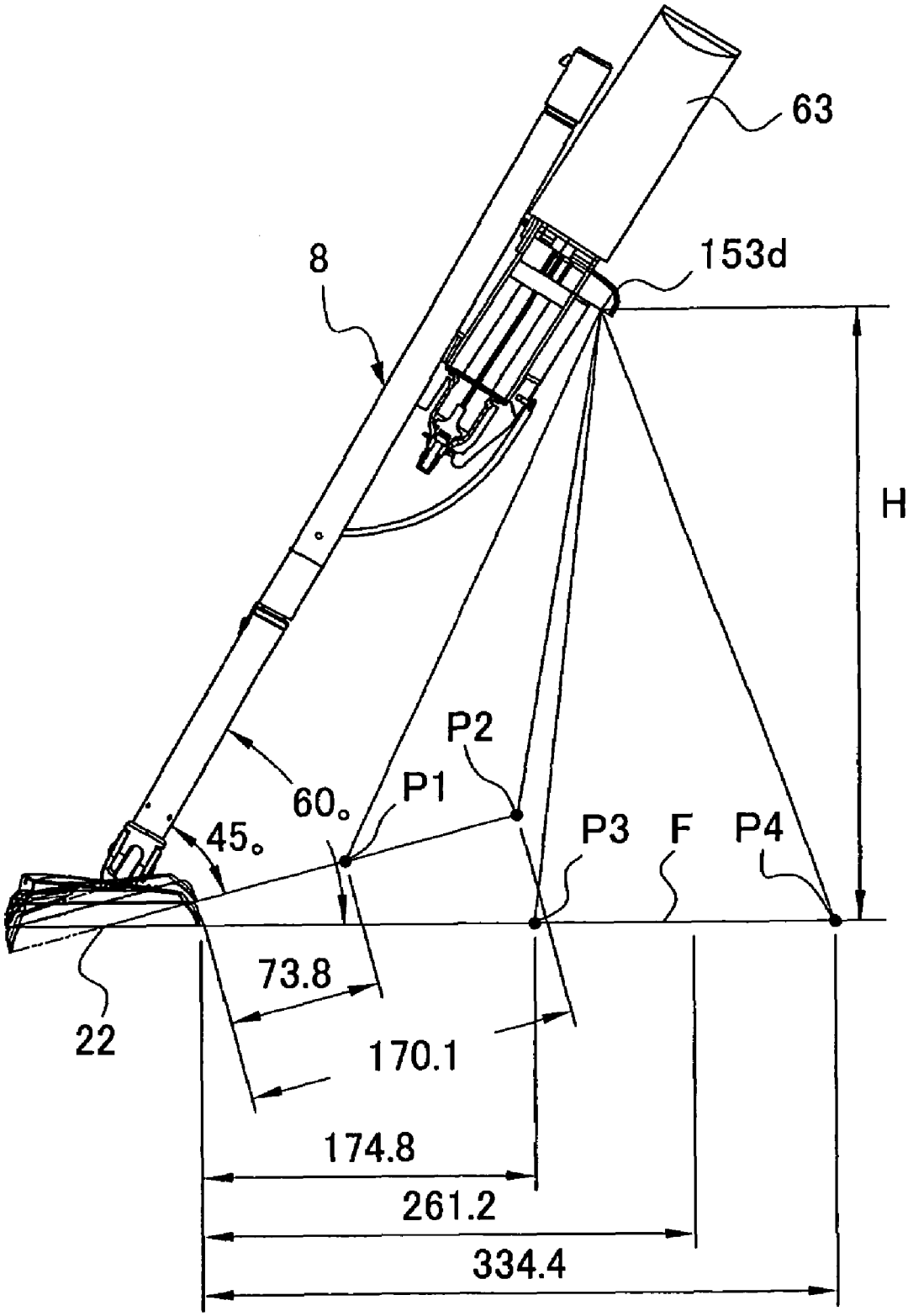
FIG. 35 is a perspective external view showing a service state of the cleaning implement in the embodiment.
Figure 36:
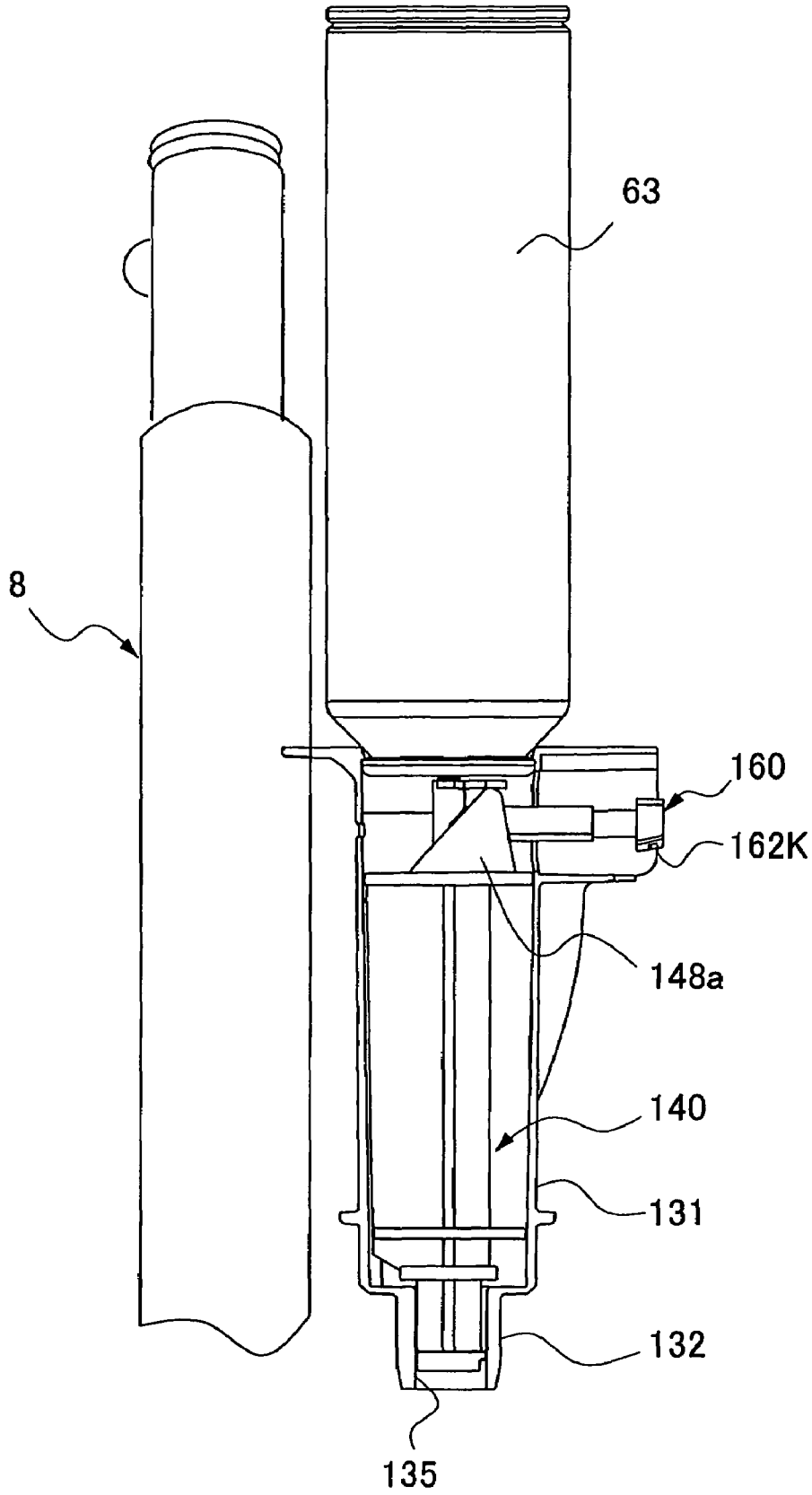
FIG. 36 is a longitudinal sectional view of a cleaning implement in a further embodiment.
Figure 37A:
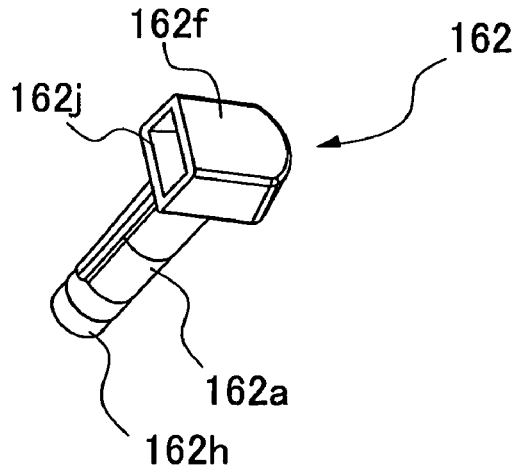
FIGS. 37A to 37C are perspective views of a fourth ejection nozzle of the cleaning implement in the further embodiment.
Figure 37B:
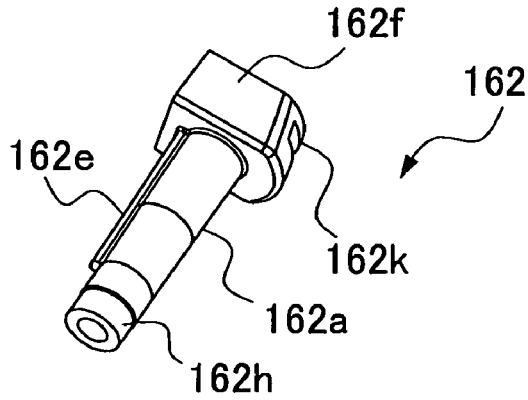
Figure 37C:
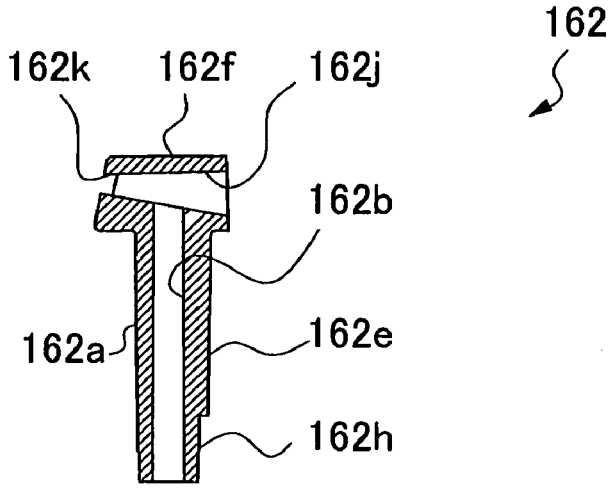
Figure 38A:
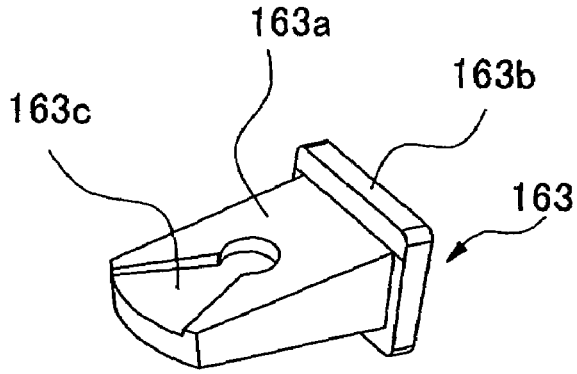
FIGS. 38A to 38C are perspective views of the fourth ejection nozzle of the cleaning implement in the embodiment.
Figure 38B:
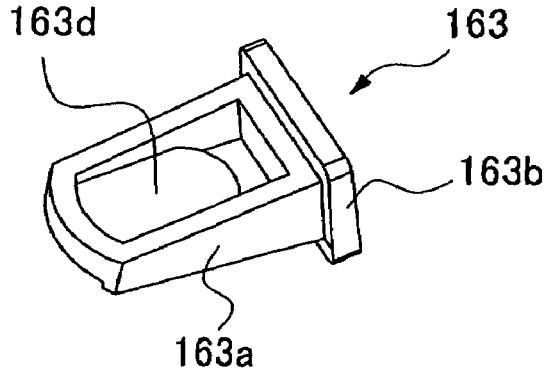
Figure 38C:
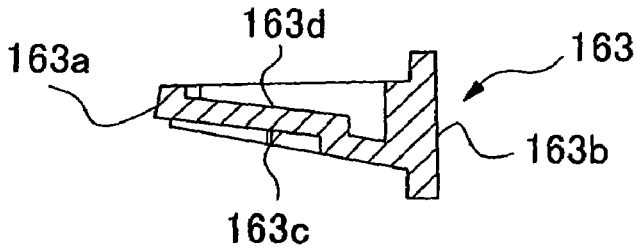
Figure 39:
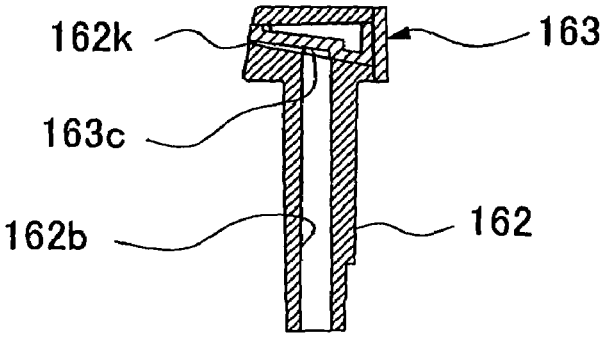
FIG. 39 is a longitudinal sectional view of the fourth ejection nozzle of the cleaning implement in the embodiment.
Figure 40:
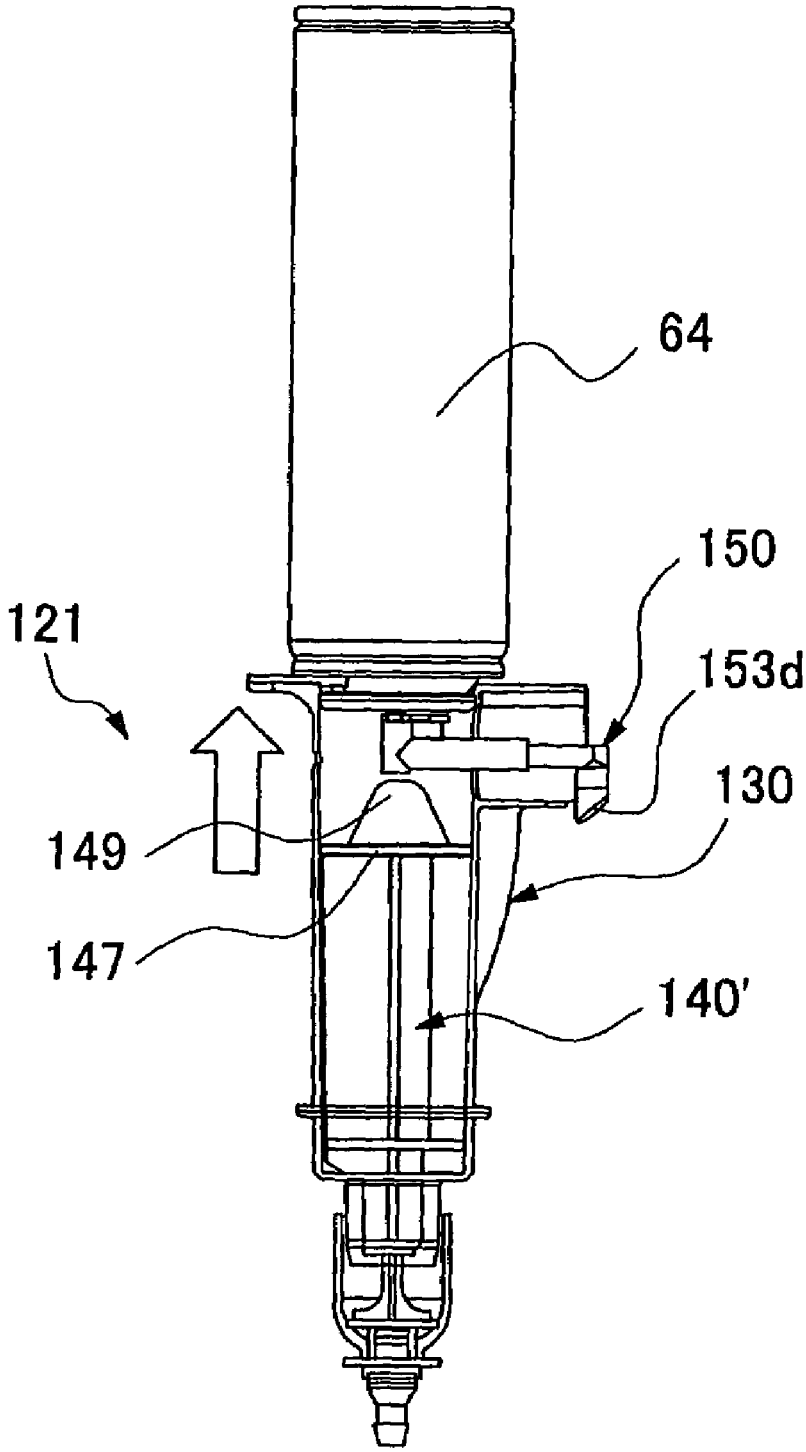
FIG. 40 is a longitudinal sectional view of a still further embodiment.

FIG. 34 is a longitudinal sectional view showing a service state of the cleaning implement in the embodiment. FIG. 35 is a perspective external view showing a service state of the cleaning implement in the embodiment. FIG. 36 is a longitudinal sectional view of the cleaning implement in a further embodiment. FIGS. 37A to 37C are perspective views of a fourth ejection nozzle of the cleaning implement in the further embodiment. FIGS. 38A to 38C are perspective views of the fourth ejection nozzle of the cleaning implement in the embodiment. FIG. 39 is a longitudinal sectional view of the fourth ejection nozzle of the cleaning implement in the embodiment. Furthermore, FIG. 40 is a longitudinal sectional view of a still further embodiment.

Referring to FIG. 1, 2 or 3, a cleaning implement 10 includes a cleaning head 2, a pipe 8 coupled to the top face of the cleaning head 2 through an universal joint 21, and a holding portion 7 mounted to an upper end of the pipe 8. A valve opening and closing device 3 is provided at a portion of the pipe 8 located between the cleaning head 2 and the holding portion 7. A first container 61 as will be described later can be mounted to the valve opening and closing device 3. The pipe 8 is formed by coupling a plurality of pipe members 8*a*, 8*b*, 8*c*, and 8*d*.

Referring to FIG. 4, the planar shape of the cleaning head 2 is rectangular, for example. A front face 2*a* and a rear face 2*b* are formed at one and the other long sides of the cleaning head 2. A right end face 2*c* and a left end face 2*d* are formed at one and the other short sides of the cleaning head 2.

The cleaning head 2 includes a hard holder 24 and a pad 25 secured to the underside of the holder 24. The holder 24 is injection molded out of a synthetic resin material such as acrylonitrile-butadiene-styrene (ABS) resin, polyethylene (PE) resin, polypropylene (PP) resin, polyethylene terephtalate (PET) resin or the like. The pad 25 is formed out of a foamed resin such as ethylene-vinyl acetate (EVA) copolymer, urethane or the like or a soft and resilient material such as rubber or the like. The pad 25 may be formed out of soft PP or PE. The holder 24 and pad 25 are secured by bonding.

Referring to FIG. 5, the bottom of the pad 25 serves as a cleaning operation surface 22. A cleaning sheet 22*a* is arranged on the cleaning operation surface 22. The cleaning operation surface 22 is essentially flat. However, in order to prevent the cleaning sheet 22*a* from sliding with respect to the cleaning operation surface 22, a plurality of small protrusions may integrally be formed with the cleaning operation surface 22.

Referring to FIG. 4, the universal joint 21 is coupled to the top face of the holder 24 between the right end face 2*c* and the left end face 2*d*. Sheet retaining mechanisms 26 are arranged on the top face of the holder 24 in the inner position of four corners. The cleaning sheet 22*a* is mounted to the sheet retaining mechanisms 26. A hole 26*a* is formed in each sheet retaining mechanism 26 on the top face of the holder 24. The hole 26*a* is covered with a deformable sheet 26*c* formed out of PE, PP, PET or the like. The cuts 26*b* are formed on each sheet 26*c*. Referring to FIG. 5, the cleaning sheet 22*a* is retained to the holder 24 by squeezing parts of the cleaning sheet 22*a* into cuts 26*b*.

Referring to FIG. 4, a liquid ejecting portion 20 is mounted on the holder 24. The liquid ejecting portion 20 is arranged between the right end face 2*c* and the left end face 2*d* of the holder 24 and in front of the universal joint 21. The liquid ejecting portion 20 includes a base 27 and the first ejection nozzle 23 arranged on the base 27. The base 27 and first ejection nozzle 23 are injection molded out of a synthetic resin such as ABS, PP, PET or the like. The first ejection nozzle 23 is fixed on the base 27 by fixing means such as fitting, bonding or screwing. The base 27 and the first ejection nozzle 23 of the liquid ejecting portion 20 may be formed integrally.

Referring to FIG. 4, a recess 24*a* that opens toward the front face 2*a* is formed in the top face of the holder 24 between the right end face 2*c* and the left end face 2*d*. The universal joint 21 is engaged in the recess 24*a*. The liquid ejecting portion 20 is arranged in the recess 24*a*. At a position reasonably distant from the cleaning operation surface 22 toward the height direction, the liquid ejecting portion 20 can eject a first fluid as will be described later from a spout 23 of the first ejection nozzle 23 forward outward of the cleaning head 2.

Referring to FIG. 6, the holding portion 7 is provided to the pipe 8 on the opposite side of the cleaning head 2, and is formed by assembling two holding casings 7*b*. The holding portion 7 is coupled to the valve opening and closing device 3, and includes a lever 71 for opening and closing a first valve 93

(refer to FIG. 10) of the first container 61 or a second valve 62*a* (refer to FIG. 21) of a second container 62 as will be described later.

Referring to FIG. 6 or 7, the lever 71 is supported to the holding portion 7 to be rotatable about a pivot 7*c* formed with the holding portion 7. Referring to FIG. 8, in order to allow an user to pull the lever 71 by an angle γ, part of the lever 71 protrudes outward from the inside of the holding portion 7 by a biasing force of a torsion coil spring 75 arranged in the holding portion 7.

A gear 71*a* having the pivot 7*c* as center of a pitch circle is partly formed with the lever 71. A pulley 74 is assembled to be rotatable about a pivot 7*d* formed with the holding portion 7. A gear 74*a* having the pivot 7*d* as center of rotation is assembled to the pulley 7.4. When the lever 71 is pulled, the gear 71*a* meshes with the gear 74*a*. Normally, the gear 71*a* does not mesh with the gear 74*a*. A spiral coil spring (not shown) is built in the pulley 74. Referring to FIG. 6 or 7, the spiral coil spring operates to rotate the pulley 74 having one end of a belt 73 wound thereon in the direction of winding the belt 73.

Referring to FIG. 7 or 8, when the user does not pull the lever 71, the pulley 74 winds the belt 73 by a winding force of the spiral coil spring, always providing a predetermined tension to the belt 73. When the user pulls the lever 71, the gear 71*a* meshes with the gear 74*a* so that the pulley 74 can wind the belt 73 by a force produced by pulling the lever 71 and a tension of the spiral coil spring.

Referring to FIGS. 1 and 2, the pipe 8 is provided with the valve opening and closing device 3 between the cleaning head 2 and the holding portion 7 and on the side that the user is situated. Referring to FIG. 9 or 10, the valve opening and closing device 3 includes a connection mechanism 31 and a cam device 33. The connection mechanism 31 renders the first container 61 detachable. The connection mechanism 31 is covered with a cover 31*c* for facilitating attachment and detachment of the first container 61. The cam device 33 is composed of a rocker arm 34 forming a dynamic articulation that reciprocates angularly and a pusher 35 following the rocker arm 34 to reciprocate linearly. The pusher 35 is formed out of a synthetic resin and is mounted in a pump 36.

The pump 36 has a shape having a U-shaped section with one end opened. An opening 36*a* at one end of the pump 36 is hermetically connected to a frame 31*a* of the connection mechanism 31. A hole 36*b* is formed at the other end (bottom) of the pump 36. The hole 36*b* is hermetically connected to one end of a hose 4 that defines a first circulation path. The other end of the hose 4 is hermetically connected to the first ejection nozzle 23 through the inside of the pipe 8.

Referring to FIG. 9 or 10, the pusher 35 includes a distal end 35*a* that abuts the first valve 93 and a collar 35*b* that closes the hole 36*b* of the bottom of the pump 36. A ring 35*c* mounted to the bottom of the pump 36 makes sliding contact with a convex 34*b* of the rocker arm 34. The distal end 35*a* and the collar 35*b* are both positioned inside the pump 36, whereas the ring 35*c* is positioned outside the pump 36. The collar 35*b* and the ring 35*c* hold the pump 36 therebetween. The collar 35*b* closes the hole 36*b* by a resilient force of the pump 36 toward the hole 36*b*. The distal end 35*a* protrudes toward the opening 36*a*.

The rocker arm 34 reciprocates angularly with a pivot 31*b* provided to the frame 31*a* as center of rotation. The other end 73*a* of the belt 73 is caught at a moving end 34*a* of the rocker arm 34. Therefore, the belt 73 extending from the pulley 74 passes through the inside of the pipe members Bb to 8*d* to be caught at the moving end 34. The convex 34*b* (refer to FIG. 9) is formed with the rocker arm 34. The convex 34 protrudes from the middle of the rocker arm 34 toward the ring 35*c* so as to be capable of making sliding contact with the ring 35*c*.

Referring to FIG. 10, the first container 61 includes a tank 61*b* for receiving the first fluid and a cap 90 mounted to an opening of the tank 61*b*. A valve hole 91*a* is formed at a distal end of the cap 90.

The internal structure of the cap 90 will be described. As shown in FIG. 11, the cap 90 includes a cap main body 91, a first ring member 92, a first valve 93, a compression coil spring 94, a second ring member 95, a valve housing 96, a seal member 97, a tube member 98, a valve protection member 99, and a valve member 100.

As shown in FIGS. 12A to 12C, the cap main body 91 includes a distal end 91*b*, a mesh portion 91*c*, and an air hole 91*d*. The valve hole 91*a* is arranged at one end of the distal end 91*b*. The distal end 91*b* accommodates the first ring member 92, the first valve 93, the compression coil spring 94, the second ring member 95, the valve housing 96, and the seal member 97. The mesh portion 91*c* is formed with a mesh groove that meshes with the opening of the tank 61*b*. The air hole 91*d* is arranged in a substantially flat surface arranged on the top of the mesh portion 91*c*.

The first ring member 92 includes a circular ring packing. The first ring member 92 seals the first fluid charged in the first container 61. The first valve 93 includes a head 93*a* and a leg 93*b*. The head 93*a* includes a cylindrical head main body and a pair of flanges arranged on both sides of the head main body. The first ring member 92 is arranged between the flanges, i.e., on the peripheral face of the head main body. One end of the head 93*a* is formed with an insertion hole into which one end of the pusher 35 is inserted. The other end of the head 93*a* is formed with the leg 93*b*. The leg 93*b* includes four blades. Each blade is formed with a convex for catching the compression coil spring 94. One end of the compression coil spring 94 is caught in a catch groove 96*e* as will be described later. On the other hand, the other end of the compression coil spring 94 is caught at the convex.

As shown in FIGS. 13A to 13C, the valve housing 96 includes a valve housing main body 96*h*, a slide hole 96*a* through which the first valve 93 slides, a flange 96*b*, and a long tube 96*c* engaged with the tube member 98. The slide hole 96*a* includes a first slide hole 96*a*' and a second slide hole 96*a*" that have different diameters. The catch groove 96*e* is arranged between the first and second slide holes 96' and 96". An opening 96*f* forming the first slide hole 96*a*' is engaged with the cap main body 91. The second ring member 95 is arranged between the opening 96*f* and the flange 96*b*. The second ring member 95 includes a circular ring packing. The long tube 96*c* is arranged at the side of the other opening 96*g* forming the second slide hole 96*a*" and on the flange 96*b*. The long tube 96*c* includes an air hole 96*d*. Two convexes 96*i* are arranged on the flange 96*b* on the side having the long tube 96*c*.

The seal member 97 includes a flange 97*a* as shown in FIG. 11. The flange 97*a* has a diameter greater than that of the flange 96*b* of the valve housing 96. The seal member 97 includes in substantially the center a through hole 97*b* through which the opening 96*g* is arranged. The long tube 96*c* and the convexes 96*i* are arranged through the seal member 97. The seal member 97 is formed out of a silicone resin.

The tube member 98 has a columnar shape. The section of the tube member 98 is shaped like a ring to allow air from the air hole 91*d* to flow into the tank 61*b*. One end of the tube member 98 is engaged with the long tube 96*c*. The tube member 98 is formed out of polyurethane (PU) resin. The valve protection member 99 is shaped like a bell. A horn portion 99*a* having an apex as engaged is arranged at an upper end of the valve protection member 99. The horn portion 99*a* is engaged with the other end of the tube member 98. The top of the valve protection member 99 includes a pair of recesses 99*b*. A convex (not shown) having a through hole engaging with the valve member 100 is arranged in the valve protection member 99. The valve member 100 is arranged in the valve protection member 99.

The valve member 100 includes a valve main body 100*a* and a flange 100*b*. The valve main body 10*a* is shaped substantially cylindrically. The valve main body 10*a* is formed out of a resilient member. A distal end 100*c* of the valve main body 10*a* has a cut shape obtained by cutting the cylindrical shape from both side faces thereof. It is noted that the cut shape is such that two plate-shaped valves are arranged to be superimposed one upon another at the distal end, and are constructed to open or close in substantially the center of the distal end. With such a construction, the distal end 100*c* allows the valves to open in substantially the center so that air from the air hole 91*d* is fed to the tank 61*b* through the tube member 98. A flange 100*b* is arranged at the other end of the valve main body 100*a*.

With the above structure, the first valve 93 is biased by the compression coil spring 94 from the inside of the cap 90, thereby obtaining the closed state of the valve hole 91*a*.

When the first container 61 is mounted to the connection mechanism 31, the outer periphery of the cap 90 makes close contact with the pump 36 hermetically, whereas the first valve 93 of the first container 61 is pressed to the distal end 35*a* against a biasing force of the compression coil spring 94. At this time, the first valve 93 of the first container 61 is slightly moved toward the tank 61*b*. However, no clearance allowing part of the first fluid received in the first container 61 to flow out toward a space defined by the pump 36 and the first valve 93 is formed between the first valve 93 and the valve hole 91*a*.

As a result, part of the first fluid received in the first container 61 does not flow out toward a space defined by the pump 36 and the first valve 93. Moreover, since the hole 36*b* is closed by the pump 36 and the pusher 35, the first fluid in the first container 61 is not moved into the hose 4 in this state.

On the other hand, when the user pulls the lever 71, the belt 73 is moved to the holding portion 7 so that the rocker arm 34 is rotated by a pulling force of the belt 73. Furthermore, since the pusher 35 is linearly moved to the holding portion 7, the first valve 93 of the first container 61 is moved in the direction of the tank 61*b*, and the collar 35*b* is moved in the direction of separating from the hole 36*b* of the pump 36. Therefore, concurrently with a clearance being produced between the collar 35*b* and the hole 36*b*, air taken in from the air hole 91*d* is supplied into the tank 61*b* through the tube member 98 and the valve member 100. With this, the first fluid in the first container 61 is supplied to the first ejection nozzle 23 through this clearance and the hose 4. The supplied first fluid is ejected forward of the cleaning head 2 from the first ejection nozzle 23. That is, the first fluid passes through the first circulation path.

Referring to FIG. 14, the valve opening and closing device 3 allows mounting of the second container 62 through an adaptor 32 in place of the first container 61. The adaptor 32 includes a cylindrical adaptor main body 32*a*, a cylinder 32*b* axially movably held in the adaptor main body 32*a*, and a second ejection nozzle 51 coupled to the cylinder 32*b*. The second ejection nozzle 51 serves as a second circulation path through which a second fluid flows.

Referring to FIG. 15, the adaptor main body 32*a* includes at one end a convex 321 of substantially the same shape as that of the cap 90 of the first container 61. Referring to FIG. 14, a first connection port 32*c* having a size that allows non-contact entry and retraction of the distal end 35*a* of the pusher 35 is formed in the center of the convex 321. Referring to FIG. 20, the other end of the adaptor main body 32*a* is formed with a second connection port 32*d* that holds detachably the second container 62. An opening 32*g* (refer to FIG. 19) is formed in the side face of the adaptor main body 32*a* on the side of the second connection port 32*d* so as to arrange a spout 51*c* of the second ejection nozzle 51 outside the adaptor main body 32*a*. Referring to FIG. 24, the spout 51*c* is positioned, preferably, at a distance in the range of about 50 to 80 cm from the cleaning operation surface 22 (refer to FIG. 3), and more preferably, at a distance of about 70 cm from the cleaning operation surface 22. Therefore, as shown in FIG. 24, in the state in which the cleaning implement 10 is used by being inclined at an angle of about 45 degrees, for example, a height H of the spout 51*c* from a floor surface F can be in the range of 40 to 60 cm from the floor surface, and more preferably, about 50 cm.

Referring to FIG. 18, a collar 323 extending in the direction orthogonal to an axis of the cylinder 32*b* is formed at one end of the cylinder 32*b*. Referring to FIG. 21, the other end of the cylinder 32*b* includes an inclined portion 32*e* that intersects the axial direction at an acute angle toward the second connection port 32*d*. An intersection angle of the axial direction and the inclined portion 32*e* is, preferably, in the range of 30 to 60 degrees. The cylinder includes a pair of side walls 32*f* arranged on both sides of the inclined portion 32*e* with a space. Referring to FIG. 20, a collar 324 that can abut on a step 325 from inside is integrally formed with the center of the cylinder 32*b*.

Referring to FIG. 16 or 17, the second ejection nozzle 51 includes a main-body portion 511 and a nozzle portion 512. The second ejection nozzle 51 is formed in a T-shape by assembling the main-body portion 511 and the nozzle portion 512. Referring to FIG. 16 or 21, one end 51*a* of the main-body portion 511 makes contact with the inclined portion 32*e*. The other end 51*b* of the main-body portion 511 is connected to the second valve 62*a*. A connection end 51*e* of the main-body portion 511 is connected to the nozzle portion 512. Referring to FIG. 17, the spout 51*c* for ejecting the second fluid is arranged at a T-shaped end of the T-shaped second ejection valve 51 in a position outside the adaptor main body 32*a*. Part of the second valve 62*a* is arranged in the space of the pair of side walls 32*f*.

Referring to FIG. 14, the cylinder 32*b* and the second ejection nozzle 51 are accommodated in the adaptor main body 32*a* from the second connection port 32*d*. Since one end of the adaptor main body 32*a* has substantially the same shape as that of the cap 90 of the first container 61, one end of the adaptor main body 32*a* is engaged with the pump 36 of the connection mechanism 31 so that the adaptor main body 32*a* is held by the connection mechanism 31. At this time, the spout 51*c* protrudes from the opening 32*g* (refer to FIG. 19). The spout 51*c* protrudes from the opening 32*g* so as to allow ejection backward or opposite of the first ejection nozzle 23 in the front and back direction of the cleaning head 2.

The second container 62 is mounted to the adaptor main body 32*a* on the side of the second connection port 32*d*. The second container 32 is a spray can including a tilt-type valve that is tilted in the direction orthogonal to an axis of the second valve 62*a* so as to eject the second fluid received in the second container 62. Therefore, when the second ejection nozzle 51 is tilted, the second fluid is ejected from the spout 51*c*. Moreover, since the spout 51*c* is positioned at the height H from the floor surface F, the second fluid ejected from the spout 51*c* may be a fluid of lower viscosity such as water as well as a fluid of higher viscosity such as foam.

By way of example, the first container 61 may be of a type of a bottle that is moved in the direction parallel to an axis of the first valve 93 (refer to FIG. 10) so as to drop the first fluid naturally. By way of example, the first fluid includes water, a liquid detergent or a liquid wax. The second fluid includes a polish such as a synthetic wax that becomes solid at room temperatures after drying such as acryl resin wax or polyethylene wax or a natural wax such as Carnauba wax. Adoption of such a wax or polish facilitates coating or wiping on the floor surface.

When the user pulls the lever 71, the lever 71 is pushed into the holding portion 7 against a biasing force of the torsion coil spring 75, rotating the gear 71*a*. With this, the gear 74*a* is rotated together with the pulley 74 to wind the belt 73. When the belt 73 is wound on the pulley 74, the pusher 35 moves the cylinder 32*b* to the second container 62.

When the cylinder 32*b* is moved to the second container 62, the inclined portion 32*e* tilts the second ejection nozzle 51 in the direction of orthogonal to the moving direction of the cylinder 32*b*. With this, referring to FIG. 24, the second fluid in the second container 62 can be ejected backward of the cleaning head 2 from the spout 51*c* of the second ejection nozzle 51.

When the user stops pulling the lever 71, the lever 71 rotates the pulley 74 in the direction of loosing the belt 73 by a biasing force of the torsion coil spring 75. With this, the pusher 35 is moved in the direction away from the cylinder 32*b*, providing no force of pushing the cylinder 32*b*. Furthermore, a returning force of the second valve 62*a* of the second container 62 acts on the inclined portion 32*e* of the cylinder 32*b*. Then, the cylinder 32*b* is moved in the direction away from the second container 62. Thus, the inclination of the second valve 62*a* with respect to the second container 62 returns to the vertical state, stopping ejection of the second fluid from the second ejection nozzle 51.

In another embodiment as shown in FIGS. 22 and 23, the second ejection nozzle 51 includes an L-shaped portion 51*h* and a collar 51*f* formed with the L-shaped portion 51*h* and extending in the direction orthogonal to the axis of the second valve 62*a*. The other end of the cylinder 32*b* includes a protrusion 32*h* that can push the collar 51*f* in the position away from the second valve 62*a*. The L-shaped portion 51*h* has one end coupled to the second valve 62*a*, and the other end formed with the spout 51*c* for ejecting the second fluid to the outside position of the adaptor main body 32*a*.

The surface with which the protrusion 32*h* makes contact is separated from a center P of rotation on which the second valve 62*a* tilts by a distance h in the axial direction. The protrusion 32*h* makes contact with the collar 51*f* spaced with respect to the second valve 62*a* in the direction away from the axial direction. As a result, reciprocation of the cylinder 32*b* is converted into rotation with the center P of rotation as center so that the second valve 62*a* is tilted by this rotation by an angle $\alpha$.

In still another embodiment as shown in FIG. 25, the valve opening and closing device 3 allows mounting of a third container 63 through an adaptor 120 in place of the first container 61. The third container 63 is a spray can including a tilt-type valve that is tilted in the direction orthogonal to an axis of a third valve 63*a* so as to eject a third fluid received in the third container 63. In this embodiment, the third container 63 contains the third fluid such as wax.

The adaptor 120 includes a cylindrical adaptor main body 130, a cylinder 140 axially movably held in the adaptor main body 130, and a third ejection nozzle 150 coupled to the cylinder 140. The third ejection nozzle 150 serves as a third circulation path through which the third fluid flows.

Referring to FIG. 25, 26 or 27, the adaptor main body 130 includes a cylindrical main-body portion 131, a convex 132 arranged at one end of the main-body portion 131 and having substantially the same shape as that of the cap 90 of the first container 61, a third connection port 133 arranged at the other end of the main-body portion 131 and for holding detachably the third container 63, and an opening 134 arranged in the vicinity of the third connection port 133 and for leading a third ejection nozzle 150 from the cylindrical inside to the outside of the adaptor main body 130.

A fourth connection port 135 having a size that allows non-contact entry and retraction of the distal end 35*a* of the pusher 35 is formed in the center of the convex 132. The fourth connection port 135 is connected to a cylindrical inner surface 136 of the main-body portion 131. The cylindrical inner surface 136 is connected to the opening 134. A groove is formed in the cylindrical inner surface 136 that extends axially.

Referring to FIG. 27, 28 or 29, the cylinder 140 includes a cylinder main body 141 obtained by combining plate-shaped members 141*a* in the shape of a cross, a collar 142 formed at one end of the cylinder main body 141, a collar 144 formed through a support 143 formed with the collar 142 and having a smaller diameter than the collar 142, a collar 146 formed through a support 145 formed with the collar 144, a collar 147 formed at the other end of the cylinder main body 141, and a pair of pressing portions 148*a* and 148*b*.

The pair of pressing portions 148*a* and 148*b* each have a substantially triangular shape with an apex positioned offset with respect to the center, and are formed with the collar 147 with a clearance therebetween that allows arrangement of the third ejection nozzle 150 (refer to FIG. 26). The collar 144 has a shape that allows contact with the step 137 of the adaptor main body 130 from inside. The collar 142 has a shape that allows sliding on the cylindrical inner surface 136 of the adaptor main body 130.

Referring to FIG. 30, 31 or 32, the third ejection nozzle 150 includes a main body 151, an arm 152, and a nozzle portion 153. The main body 151 is formed in a T-shape obtained by two pipe-shaped portions 151*a* and 151*b* intersecting each other substantially orthogonally. Collars 154*a* and 154*b* extend from one end of the pipe-shaped portion 151*b*. A groove 151*d* extending axially is formed in the inner peripheral surface of the pipe-shaped portion 151*a*.

A fit hole 151*f* that can fit with the third valve 63*a* of the third container 63 is formed at an end of pipe-shaped portion 151*b*. The fit hole 151*f* is connected to a through hole 151*e* that passes through the main body 151. One opening of the through hole 151*e* is formed with a fit portion 151*c* that can fit with a fit portion 152*h* of the arm 152. The arm 152 is formed in a roughly L-shape obtained by two pipe-shaped portions 152*a* and 152*b* intersecting each other, and has a through hole 152*g*. A convex 152*e* (refer to FIG. 30) is formed on the outer peripheral surface of the pipe-shaped portion 152*a*. An end of the pipe-shaped portion 152*a* includes fit portion 152*h* that fits with the pipe-shaped portion 151*a* so that the convex 152*e* fits in the groove 151*d*. With this, the pipe-shaped portion 152*a* and the pipe-shaped portion 151*a* ensure a relative positional relationship, and allow hermetic connection between the through hole 151*e* and the through hole 152*g*.

A ring-shaped convex 152*f* is formed on the circumference of an end of the pipe-shaped portion 152*b*. A concave 152*d* is formed in the pipe-shaped portion 152*a* on the side of the pipe-shaped portion 152*b*.

Referring to FIG. 33, the nozzle portion 153 includes a nozzle main body 153*a* having a hollow pipe-shaped through hole 153*e* and a spout 153*d* formed at one end thereof and connected to the through hole 153*e*. The other end of the nozzle main body 153*a* is open to form a fit opening 153*b*. A convex 153*c* that can fit in the concave 152*d* is formed on part of the circumference of the fit opening 153*b*. A groove 153*c* that can fit with the convex 152*f* is formed in the center of the fit opening 153*b*. With this, the nozzle portion 153 ensures a relative positional relationship with respect to the arm 152, and allows hermetic connection between the through holes 152*g* and 153*e* of the arm 152.

Referring to FIG. 31, the third ejection nozzle 150 provides hermetic connection from the third valve 63*a* of the third container 63 to the spout 153*d*, forming a third circulation path. Therefore, liquid, such as wax, which is ejected from the third valve 63*a*, can be ejected from the spout 153*d*.

Referring to FIG. 25 or 26, the cylinder 140 is accommodated into the adaptor main body 130 from the third connection port 133. The cylinder 140 is maintained in the state in which the collars 142 and the collar 147 are slidable axially on the cylindrical inner surface 136. The cylinder 140 includes plate-shaped member 141*a* extending axially, and is slidably arranged in a groove (not shown) formed in the cylindrical inner surface 136. With this, the cylinder 140 is placed on the cylindrical inner surface 136 in the state of being movable axially, but not rotatable with the axial direction as center of rotation. The collar 146 of the cylinder 140 is positioned in the vicinity of the connection port 135 (refer to FIG. 27).

The fit hole 151*f* of the third ejection nozzle 150 assembled by the main body 151, arm 152, and nozzle portion 153 is hermetically fitted with the third valve 63*a* of the third container 63 (refer to FIG. 31).

Referring to FIG. 31, the third container 63 is fitted and held in the third connection port 133 of the adaptor main body 130. At this time, the spout 153*d* of the third ejection nozzle 150 protrudes from the opening 134. The third ejection nozzle 150 protrudes from the opening 134 so as to allow ejection backward or opposite of the first ejection nozzle 23 in the front and back direction of the cleaning head 2.

Since one end of the adaptor main body 130 has substantially the same shape as that of the cap 90 of the first container 61, it can be fitted in the pump 36 of the connection mechanism 31 so that the adaptor main body 130 is held by the connection mechanism 31.

Referring to FIG. 34, the apexes of the pair of pressing parts 148*a* and 148*b* of the cylinder 140 are arranged in the position where they can push the collars 154*a* and 154*b* (refer to FIG. 25 or 26).

When the user pulls the lever 71, the lever 71 is pushed into the holding portion 7 against a biasing force of the torsion coil spring 75, rotating the gear 71*a*. With this, the gear 74*a* is rotated together with the pulley 74 to wind the belt 73. When the belt 73 is wound on the pulley 74, the pusher 35 pushes the convex 146*a* formed in the collar 146 of the cylinder 140, moving the cylinder 140 to the third container 63.

Referring to FIG. 34, when the cylinder 149 moves to the third container 63, each of the pair of pressing parts 148*a* and 149*b* presses the collar 154*a* and 154*b* respectively. Then, the pair of pressing parts inclines the third valve 63*a*. With this, the third liquid which is in the third container 63 can be ejected from the spout 153*d* of the third ejection nozzle 150 backward of the cleaning head 2.

Therefore, referring to FIG. 33, when the third ejection nozzle 51 is tilted, the third fluid is ejected from the spout 153*d*. Moreover, since the spout 153*d* is positioned at the height H from the floor surface F, the third fluid ejected from the spout 153*d* may be a fluid of lower viscosity such as water as well as a fluid of higher viscosity such as foam. Specifically, the spout 153*d* is positioned, preferably, at a distance in the range of about 50 to 80 cm from the cleaning operation surface 22 (refer to FIG. 35), and more preferably, at a distance of about 70 cm from the cleaning operation surface 22. Therefore, in the state in which the cleaning implement 10 is used by being inclined at an angle of about 45 degrees, for example, the height H of the spout 153*d* from the floor surface F can be in the range of 40 to 60 cm from the floor surface F, and more preferably, about 50 cm.

Referring to FIG. 35, when adopting the pipe 8 of 1145 mm length, an angle of 60 degrees between the pipe 8 and the floor surface F, and the third container 63 with a tilt-type valve, trial calculation is made about the minimum ejection area and maximum ejection area of a wax ejected from the spout 153*d* of the third ejection nozzle 150. The results of trial calculation are given by points P3 and P4. In this case, the minimum designates a state in which the third valve 63*a* of the aerosol can (third container 63) with a tilt-type valve just begins to open when a force of pulling the lever is 20N, whereas the maximum designates a state in which the third valve 63*a* opens maximally when a force of pulling the lever 71 is 24N.

In the drawing, points P1 and P2 correspond to the case in which an angle between the floor F and the pipe 8 is 45 degrees. The point P1 designates a content landing point when pulling the lever 71 slightly so that the third valve 63*a* just begins to open, whereas the point P2 designates a content landing point when pulling the lever 71 maximally so that the third valve 63*a* opens to the maximum extent.

When the user stops pulling the lever 71, the lever 71 rotates the pulley 74 in the direction of loosening the belt 73 by a biasing force of the torsion coil spring 75. With this, the pusher 35 is moved in the direction away from the cylinder 140, providing no force of pushing the cylinder 140. Furthermore, a returning force of the third valve 63*a* of the third container 63 acts on the pair of pressing portions 148*a* and 148*b* of the cylinder 140. Then, the cylinder 140 is moved in the direction away from the third container 63. Thus, the inclination of the third valve 63*a* with respect to the third container 63 returns to the vertical state, stopping ejection of the third fluid from the third ejection nozzle 51.

In still another embodiment as shown in FIG. 36, a fourth ejection nozzle 160 is provided to the third container 63 in place of the third ejection nozzle 150. The fourth ejection nozzle 160 has a shape roughly like a hammer, and is composed of a support 162 and a nozzle portion 163 in place of the arm 152 and nozzle portion 153 of the third ejection nozzle 150.

Referring to FIGS. 37A to 37C, the support 162 is formed by making a cylindrical portion 162*a* with a through hole 162*b* and a head portion 162*f* intersect each other. A convex 162*e* extending axially is formed on the outer periphery of the cylindrical portion 162*a*. The convex 162*e* engages in a groove 151*d*, and one end 162*h* of the cylindrical portion 162*a* fits in the fit portion 151*c*. A wedge-shaped inner surface 162*j* is formed on the head portion 162*f*, and has a bottom formed with an opening 162*k*. A thorough hole 162*b* is connected to the inner surface 162*j*.

Referring to FIGS. 38A to 38C, a nozzle portion 163 of a wedge shape includes a wedge portion 163*a* and a plate portion 163*b*. A groove 163*c* is formed in one surface of the wedge portion 163*a*, which is linked with an end face of the wedge portion 163*a*. A concave 163*d* is formed in the other surface of the wedge portion 163*a*.

Referring to FIG. 39, the fourth ejection nozzle 160 is formed by press fitting the wedge portion 163*a* of the nozzle portion 163 into the inner surface 162*j* of the head portion 162*f*. With this, the groove 163*c* and the inner surface 162*j* of the head portion 162*f* cooperate to define part of a fourth circulation path that communicates with the through hole 152*g*. Specifically, fluid flowing through the through hole 162*b* strikes the bottom of the groove 163*c* and turns to the opening 162*k* for ejection therefrom.

Referring to FIG. 40, the adaptor 121 uses a fourth container 64 provided with a press-down-type valve in place of the third container 63 provided with a tilt-type valve. A cylinder 140' includes a convex 149 in the center of the collar 147. When the cylinder 140' is moved axially (direction of an arrow), the convex 149 pushes the third ejection nozzle 150, so that the content of the fourth container 64 is ejected from the spout 153*d* of the third ejection nozzle 150. Therefore, the cleaning implement 10 using the fourth container 64 provided with a press-down-type valve can carry out ejection in a given range even if pulling conditions of the lever 71 change during cleaning, since an angle of the third ejection nozzle does not change.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A cleaning tool, comprising:

a cleaning head having a cleaning operation surface at a bottom of the cleaning head;

a holding portion adapted to be held by a user;

a pipe connecting the cleaning head and the holding portion; and a container holder having a valve opening and closing device and positioned on the pipe at a distance from the cleaning head along an axis of the pipe, the valve opening and closing device being adapted to selectively hold a first container containing a first fluid or an adaptor coupled with a second container containing a second fluid, wherein the cleaning head includes a first ejection nozzle fluidly communicable with the first container, when the first container is placed in the container holder, for receiving and ejecting the first fluid forward of the cleaning head, the valve opening and closing device comprises a connection mechanism which is detachably attachable to the first container, and the adaptor which is detachably attachable to and between the connection mechanism and the second container, the adaptor comprises a second ejection nozzle fluidly communicable with the second container, when the second container is placed in the container holder, for receiving and ejecting the second fluid rearward of the cleaning head, the holding portion includes a lever coupled to the valve opening and closing device for opening and closing a first valve of the first container or a second valve of the second container.

2. The cleaning tool according to claim 1, wherein the second ejection nozzle comprises a spout adapted to eject the second fluid in a direction substantially parallel to the pipe.

3. The cleaning tool according to claim 1, wherein the connection mechanism is connected to the first valve of the first container, when the first container is received in the container holder, to open and close the first valve.

4. The cleaning tool according to claim 1, wherein the first container is a bottle that, when the first container is received in the container holder, is arranged parallel to an axis of the first valve so as to drop the first fluid.

5. The cleaning tool according to claim 1, wherein, when the second container is received in the container holder, the second ejection nozzle is connected to the second valve of the second container.

6. The cleaning tool according to claim 1, wherein the second container is a tilt-type spray can that, when the second container is received in the container holder, is tilted in the direction orthogonal to an axis of the second valve for ejecting the second fluid.

7. The cleaning tool according to claim 1, wherein the connection mechanism comprises a cam device including a rocker arm reciprocable angularly, and a pusher following the rocker arm to reciprocate linearly, and the holding portion comprises a pulley rotatable interlockingly with rotary motion of the lever, and a belt having one end caught at a moving end of the rocker arm and the other end wound on the pulley for transmitting a displacement of the lever to the pusher.

8. The cleaning tool according to claim 7, wherein the adaptor comprises a cylindrical adaptor main body, a cylinder held inside the adaptor main body to be movable axially and the second ejection nozzle coupled to the cylinder, the adaptor main body having one end having a first connection port detachably held to the connection mechanism and the other end having a second connection port for detachably holding the second container, the cylinder having one end abutting on a distal end of the pusher toward the first connection port and the other end having an inclined portion that intersects the axial direction of the cylinder at an acute angle toward the second connection port, wherein the second ejection nozzle is formed in a T-shape, the T-shaped second ejection nozzle having one end coupled to the inclined portion and the other end connected to the second valve, the T-shaped second ejection nozzle having a spout at a T-shaped end for ejecting the second fluid to the outside of the adaptor main body.

9. The cleaning tool according to claim 8, wherein the cylinder includes a pair of side walls arranged on both sides of the inclined portion with a space, the second valve having a part arranged in the space.

10. The cleaning tool according to claim 7, wherein the adaptor comprises a cylindrical adaptor main body, a cylinder held inside the adaptor main body to be movable axially and the second ejection nozzle coupled to the cylinder, the adaptor main body having one end having a first connection port detachably held to the connection mechanism and the other end having a second connection port for detachably holding the second container, wherein the second ejection nozzle comprises an L-shaped portion and a collar formed with the L-shaped portion and extending in the direction orthogonal to the axis of the second valve, the cylinder having one end abutting a distal end of the pusher toward the first connection port and the other end having a protrusion that can push the collar in a position distant from the second valve, the L-shaped portion having one end coupled to the second valve and the other end formed with a spout for ejecting the second fluid to the outside of the adaptor main body.

11. The cleaning tool according to claim 2, wherein, when the first container is received in the container holder, the connection mechanism is connected to the first valve of the first container to open and close the first valve.

12. A cleaning tool comprising:

a cleaning head having a cleaning operation surface at a bottom;

a holding portion arranged on the side opposite the cleaning head;

a pipe that couples the cleaning head and the holding portion; and a valve opening and closing device provided to the pipe, the valve opening and closing device being able to selectively hold one of a first container receiving a first fluid and a second container receiving a second fluid, the valve opening and closing device comprising a connection mechanism from which the first container is detachable and an adaptor coupled to the connection mechanism and from which the second container is detachable, the cleaning head comprising a first ejection nozzle which ejects the first fluid from the connection mechanism to the outside of the cleaning head, the adapter comprising a second ejection nozzle which ejects the second fluid from the adapter, the holding portion comprising a lever coupled to the valve opening and closing device, the lever opening and closing the first valve of the first container or the second valve of the second container, wherein the first ejection nozzle can eject the first fluid forward of the cleaning head, and the second ejection nozzle can eject the second fluid rearward of the cleaning head when using the cleaning tool by positioning the cleaning head at the front and the holding portion at the rear, wherein the connection mechanism comprises a cam device including a rocker arm forming a dynamic articulation that reciprocates angularly and a pusher following the rocker arm to reciprocate linearly, the holding portion comprising a pulley rotated interlockingly with rotary motion of the lever and a belt having one end caught at a moving end of the rocker arm and the other end wound on the pulley, the belt transmitting a displacement of the lever to the pusher, wherein the adaptor comprises a cylindrical adaptor main body, a cylinder held inside the adaptor main body to be movable axially and the second ejection nozzle coupled to the cylinder, the adaptor main body having one end having a first connection port detachably held to the connection mechanism and the other end having a second connection port for detachably holding the second container, the cylinder having one end abutting on a distal end of the pusher toward the first connection port and the other end having an inclined portion that intersects the axial direction of the cylinder at an acute angle toward the second connection port, wherein the second ejection nozzle is formed in a T-shape, the T-shaped second ejection nozzle having one end coupled to the inclined portion and the other end connected to the second valve, the T-shaped second ejection nozzle having a spout at a T-shaped end for ejecting the second fluid to the outside of the adaptor main body.

13. The cleaning tool according to claim 12, wherein the cylinder includes a pair of side walls arranged on both sides of the inclined portion with a space, the second valve having a part arranged in the space.

14. A cleaning tool comprising:

a cleaning head having a cleaning operation surface at a bottom;

a holding portion arranged on the side opposite the cleaning head;

a pipe that couples the cleaning head and the holding portion; and a valve opening and closing device provided to the pipe, the valve opening and closing device being able to selectively hold one of a first container receiving a first fluid and a second container receiving a second fluid, the valve opening and closing device comprising a connection mechanism from which the first container is detachable and an adaptor coupled to the connection mechanism and from which the second container is detachable, the cleaning head comprising a first ejection nozzle which ejects the first fluid from the connection mechanism to the outside of the cleaning head, the adapter comprising a second ejection nozzle which ejects the second fluid from the adapter, the holding portion comprising a lever coupled to the valve opening and closing device, the lever opening and closing the first valve of the first container or the second valve of the second container, wherein the first ejection nozzle can eject the first fluid forward of the cleaning head, and the second ejection nozzle can eject the second fluid rearward of the cleaning head when using the cleaning tool by positioning the cleaning head at the front and the holding portion at the rear, wherein the connection mechanism comprises a cam device including a rocker arm forming a dynamic articulation that reciprocates angularly and a pusher following the rocker arm to reciprocate linearly, the holding portion comprising a pulley rotated interlockingly with rotary motion of the lever and a belt having one end caught at a moving end of the rocker arm and the other end wound on the pulley, the belt transmitting a displacement of the lever to the pusher, wherein the adaptor comprises a cylindrical adaptor main body, a cylinder held inside the adaptor main body to be movable axially and the second ejection nozzle coupled to the cylinder, the adaptor main body having one end having a first connection port detachably held to the connection mechanism and the other end having a second connection port for detachably holding the second container, wherein the second ejection nozzle comprises an L-shaped portion and a collar formed with the L-shaped portion and extending in the direction orthogonal to the axis of the second valve, the cylinder having one end abutting on a distal end of the pusher toward the first connection port and the other end having a protrusion that can push the collar in a position distant from the second valve, the L-shaped portion having one end coupled to the second valve and the other end formed with a spout for ejecting the second fluid to the outside of the adaptor main body.

15. The cleaning tool according to claim 1, wherein, when the first container is received in the container holder, the first container is directly detachably attachable to the connection mechanism; and when the second container is received in the container holder, the second container is indirectly detachably attachable to the connection mechanism via the adaptor.

16. The cleaning tool according to claim 1, wherein the second ejection nozzle is at about 50 cm to 80 cm from the cleaning operation surface.

* * * * *